US005181014A

United States Patent [19]

Dalrymple et al.

[11] Patent Number: 5,181,014

[45] Date of Patent: Jan. 19, 1993

[54] METHOD AND APPARATUS FOR REPRESENTING THREE-DIMENSIONAL COLOR DATA IN A ONE-DIMENSIONAL REFERENCE SYSTEM

[75] Inventors: John C. Dalrymple, Portland; Scott W. Bigger, Tigard, both of Oreg.

[73] Assignee: Tektronix, Inc., Wilsonville, Oreg.

[21] Appl. No.: 355,866

[22] Filed: May 22, 1989

Related U.S. Application Data

[63] Continuation of Ser. No. 113,030, Oct. 26, 1987, abandoned.

[51] Int. Cl.[5] ..... G09L 1/28

[52] U.S. Cl. ..... 340/703; 340/799

[58] Field of Search ..... 340/703, 702, 701, 750, 340/798, 799; 358/80, 75

[56] References Cited

U.S. PATENT DOCUMENTS

| | | | |
|---|---|---|---|
| 4,509,043 | 4/1985 | Mossaides | 340/703 |
| 4,598,282 | 7/1986 | Pugsley | 340/703 |
| 4,694,286 | 9/1987 | Bergstedt | 340/703 |
| 4,717,954 | 1/1988 | Fujita et al. | 358/80 |

OTHER PUBLICATIONS

"Raster Technologies Model One/25 Programming Guide" Raster Technologies, Revision 4.1, Dec. 12, 1983, pp. 24–39.

*Primary Examiner*—Alvin E. Oberley

*Attorney, Agent, or Firm*—Francis I. Gray; Robert S. Hulse

[57] ABSTRACT

A method and apparatus are disclosed for representing and displaying the true (actual) color of an image in an index color system. The user specifies the number of color levels necessary to represent the range of displayable colors, and specifies the color (the red, green, blue primary color values) desired for an image. From the specified number, the apparatus calculates RGB (red, green, blue) color values, and stores them in memory in a manner suitable for referencing by an index type address. From the specified color, the apparatus calculates an index suitable for referencing the desired RGB color values from the stored color values. The apparatus comprises a keyboard and a port to a host computer for inputting index color data and true color data, a processing means coupled to the keyboard and/or host computer for producing index-type data from true color data, a memory means for storing the input data and data produced by the processing means, and a display means for displaying stored data.

1 Claim, 6 Drawing Sheets

COLOR MAP MEMORY

| | RED BRIGHTNESS (DERIVED) | GREEN BRIGHTNESS (DERIVED) | BLUE BRIGHTNESS (DERIVED) |
|---|---|---|---|
| | 0 1 0 1 0 1 0 1 | 0 0 0 0 0 0 0 0 | 0 1 0 1 0 1 0 1 |
| | 0 1 0 1 0 1 0 1 | 0 0 0 0 0 0 0 0 | 1 0 1 0 1 0 1 0 |
| | 0 1 0 1 0 1 0 1 | 0 0 0 0 0 0 0 0 | 1 1 1 1 1 1 1 1 |
| | 0 1 0 1 0 1 0 1 | 0 1 0 1 0 1 0 1 | 0 0 0 0 0 0 0 0 |
| | 0 1 0 1 0 1 0 1 | 0 1 0 1 0 1 0 1 | 0 1 0 1 0 1 0 1 |
| | 0 1 0 1 0 1 0 1 | 0 1 0 1 0 1 0 1 | 1 0 1 0 1 0 1 0 |
| | 0 1 0 1 0 1 0 1 | 0 1 0 1 0 1 0 1 | 1 1 1 1 1 1 1 1 |
| | 0 1 0 1 0 1 0 1 | 1 0 1 0 1 0 1 0 | 0 0 0 0 0 0 0 0 |
| | 0 1 0 1 0 1 0 1 | 1 0 1 0 1 0 1 0 | 0 1 0 1 0 1 0 1 |
| | 0 1 0 1 0 1 0 1 | 1 0 1 0 1 0 1 0 | 1 0 1 0 1 0 1 0 |
| 00 01 10 11 → | 0 1 0 1 0 1 0 1 | 1 0 1 0 1 0 1 0 | 1 1 1 1 1 1 1 1 |
| | 0 1 0 1 0 1 0 1 | 1 1 1 1 1 1 1 1 | 0 0 0 0 0 0 0 0 |
| | 0 1 0 1 0 1 0 1 | 1 1 1 1 1 1 1 1 | 0 1 0 1 0 1 0 1 |
| | 0 1 0 1 0 1 0 1 | 1 1 1 1 1 1 1 1 | 1 0 1 0 1 0 1 0 |
| | 0 1 0 1 0 1 0 1 | 1 1 1 1 1 1 1 1 | 1 1 1 1 1 1 1 1 |
| | 1 0 1 0 1 0 1 0 | 0 0 0 0 0 0 0 0 | 0 0 0 0 0 0 0 0 |
| | 1 0 1 0 1 0 1 0 | 0 0 0 0 0 0 0 0 | 0 1 0 1 0 1 0 1 |
| | 1 0 1 0 1 0 1 0 | 0 0 0 0 0 0 0 0 | 1 0 1 0 1 0 1 0 |
| | 1 0 1 0 1 0 1 0 | 0 0 0 0 0 0 0 0 | 1 1 1 1 1 1 1 1 |
| | 1 0 1 0 1 0 1 0 | 0 1 0 1 0 1 0 1 | 0 0 0 0 0 0 0 0 |
| | 1 0 1 0 1 0 1 0 | 0 1 0 1 0 1 0 1 | 0 1 0 1 0 1 0 1 |

METHOD AND APPARATUS FOR REPRESENTING THREE-DIMENSIONAL COLOR DATA IN A ONE-DIMENSIONAL REFERENCE SYSTEM

This is a continuation of application Ser. No. 113,030 filed Oct. 26, 1987 and now abandoned.

BACKGROUND OF THE INVENTION

This invention relates generally to the display of color images on a computer terminal and, more particularly, to a method of processing, storing, and referencing data representing image color.

In many computer terminal systems, image color data are stored as R,G,B (red, green, blue) color component values in predetermined memory locations. Often, red values are stored in one group of memory locations, green values in another, and blue values in a third group. To select a color, made up of one color value from each of the groups, the user usually specifies a color number or index. The index, which represents a single (one-dimensional) address, permits access to the particular set of RGB values representing the selected color. One such prior art "single index" system is described, for example, in U.S. Pat. No. 4,509,043 issued Apr. 2, 1985 to inventor P. X. Mossaides.

Another type of prior art system is the "true color" system, in which the true or actual colors of an object are sought to be displayed. One such true color system is described, for example, in the Model One/25 Programming Guide published Dec. 12, 1983 by Raster Technologies Corporation. In such a true color system, the user generally specifies the RGB color values themselves (rather than color numbers or indexes) to represent a selected color. The "color values" approach is representative of the true color system—a three-dimensional color referencing system. The "color number" approach is representative of the index color system—a one-dimensional color referencing system.

True color systems are generally used to produce shaded images, to display scanned-in images, and to simulate physical phenomena such as colored lights illuminating a scene composed of colored objects. Indexed color systems are generally used to depict color of icon symbols, to represent scalar values, or to distinguish image segments (e.g., primitives such as points, lines, arcs, circles, rectangles, polygons, and text).

Often it is desirable to display symbolic icons, specified in index color, superimposed on shaded images specified in true color. To accomplish this, what is needed is a system which would permit both true-color representation and index color representation.

SUMMARY OF INVENTION

In accordance with the illustrated preferred embodiment of the invention, a method and apparatus is disclosed which provides for the display of both true-color images and index color images. The user may specify either a color number to denote index color, or RGB color values to denote true color. Index color operations and true color operations are performed in an index color environment. To perform true color operation in an index color environment, the apparatus computes one-dimensional index-type data from user-supplied three-dimensional true color data. The user specifies the number of color levels to be used in representing the range of displayable red, green and blue colors, and specifies the RGB values of the color to be displayed. The apparatus derives true color data (RGB color level values) from the number of color levels specified by the user, stores the derived data in memory in a predetermined arrangement suitable for referencing by a single address or index, and derives from the user-specified RGB values a single address for referencing the stored data.

The apparatus comprises a keyboard and a port to a host computer for inputting index color data and true color data, a processing means coupled to the keyboard and/or host computer for producing index-type data from true color data, a memory means for storing the input data and data produced by the processing means, and a display means for displaying stored data.

DESCRIPTION OF THE PREFERRED EMBODIMENT

Figure 1:
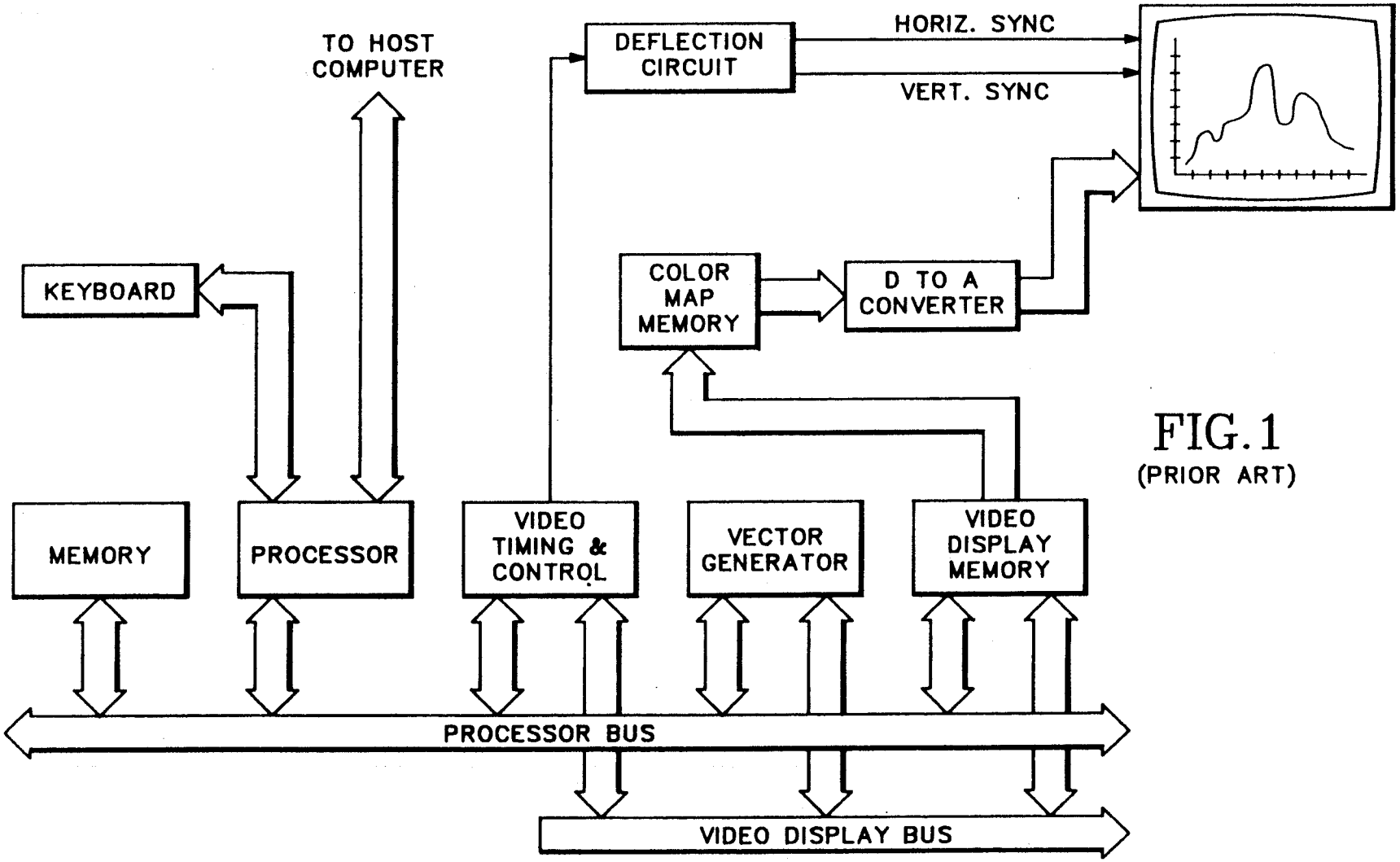
FIG. 1 (PRIOR ART)
FIG. 1 is block diagram of a system of the prior art capable of performing index color operations.
Figure 2:
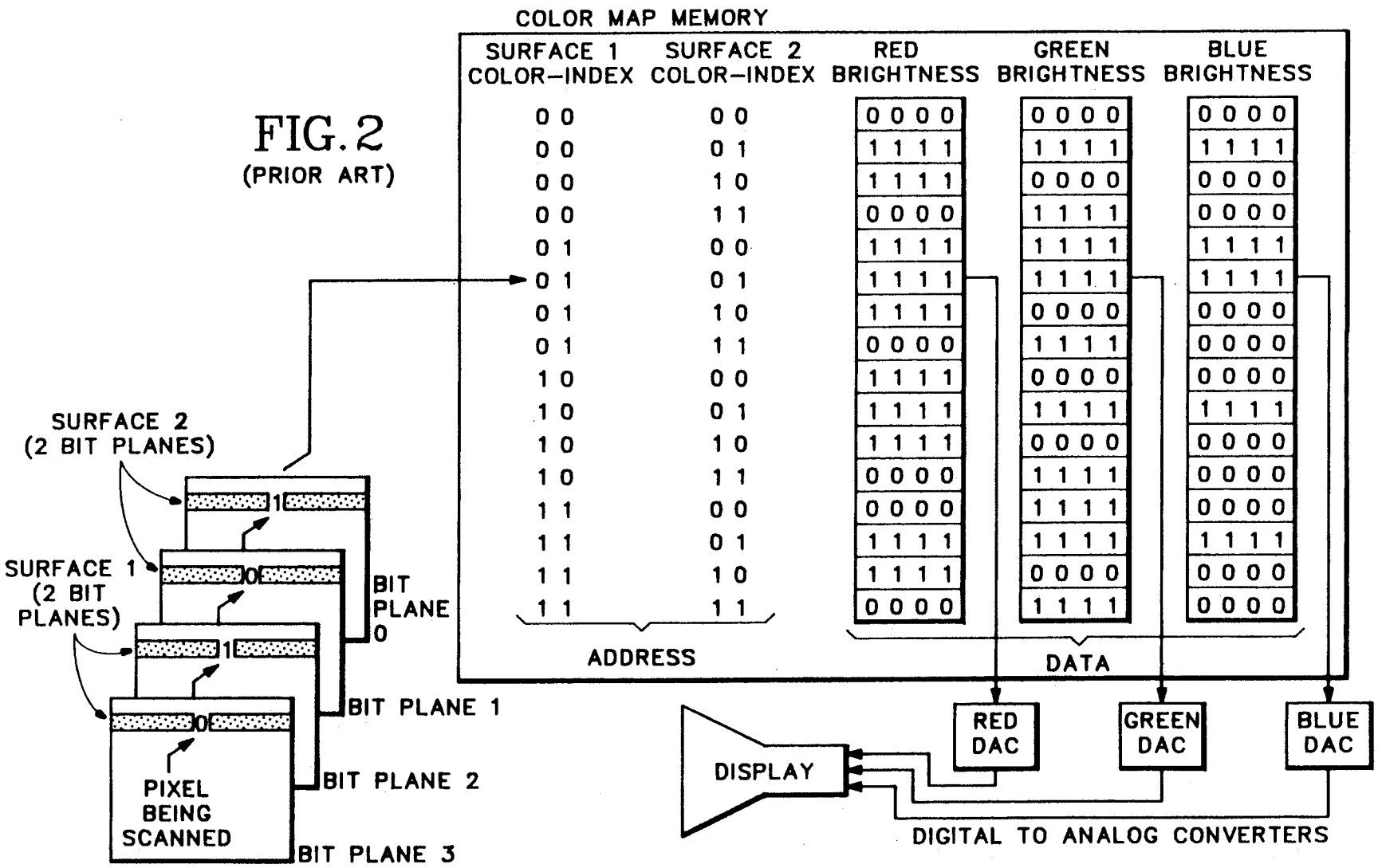
FIG. 2 (PRIOR ART)
FIG. 2 is a block diagram showing an arrangement of data in a memory of the system of FIG. 1.
Figure 3:
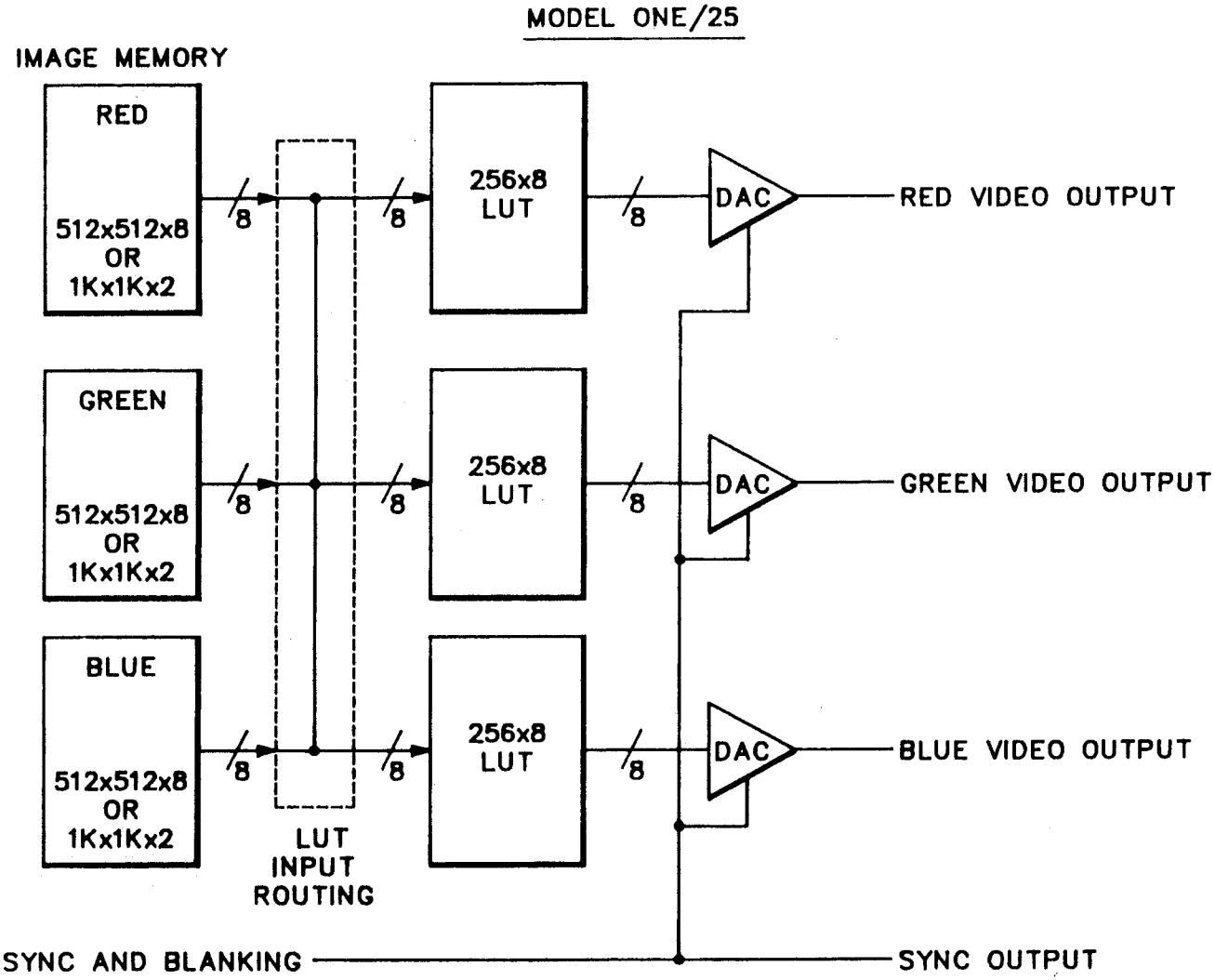
FIG. 3 (PRIOR ART)
FIG. 3 is a block diagram of a system of the prior art capable of performing true color operations.

FIG. 1 shows a system of the prior art capable of performing index color operations. FIG. 2 shows a color map memory of the system, RGB data typically stored in the memory, and a one-dimensional (single color index) address scheme for referencing stored data. FIG. 3 shows a three-dimensional address scheme of the prior art for referencing stored data. From user-supplied RGB values stored in image memory, references are made to color values stored in three look-up tables (LUTs). FIG. 2 shows a one address (index) scheme, while FIG. 3 shows a three address (true color) scheme.

Figure 4:
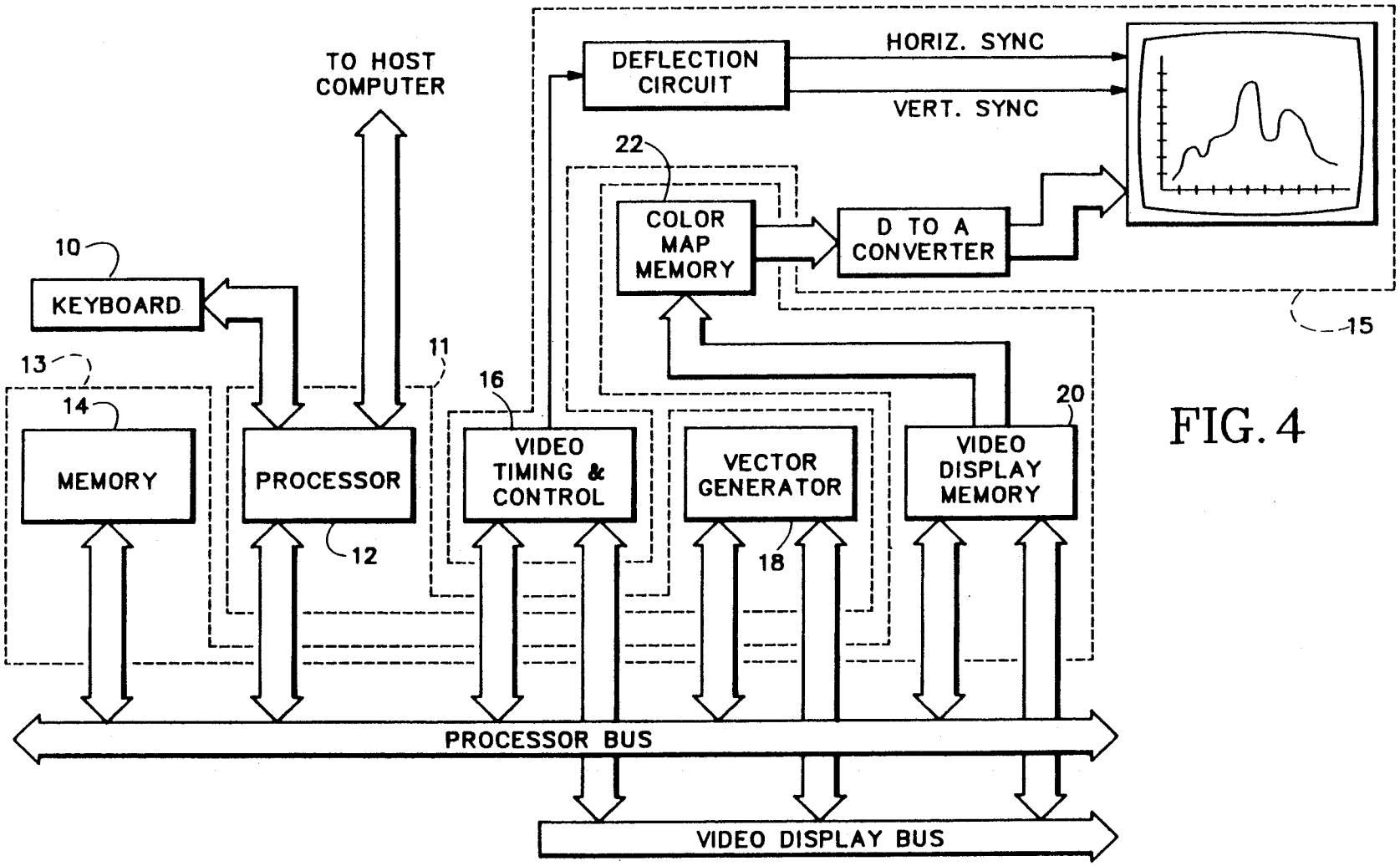
FIG. 4 is a block diagram of the apparatus of the present invention for performing index color operations and true color operations in an index color environment.

FIG. 4 shows a true-color one-address scheme, the scheme utilized by the apparatus of the present invention. Like the prior art system described in U.S. Pat. No. 4,509,043, the apparatus of the present invention is capable of performing index color operations. Unlike prior art systems, the apparatus is capable of performing true color operations in an index color environment.

The apparatus comprises a keyboard 10 and port to a host computer for inputting index color data and true color data, a processing means 11 coupled to the keyboard and/or host computer for producing index-type data from true color data, a memory means 13 for storing the input data and data produced by the processing means, and a display means 15 for displaying stored data.

The processing means 11 includes a microprocessor 12 having a ROM (read only memory, not shown) with a stored program, and a vector generator 18. The memory means 13 includes a memory 14 for storing index information, a video display memory 20, and a color map memory 22. The display means 15 includes a video timing and control circuit 16, and a CRT (cathode ray tube) display with associated deflection circuit and D to A (digital-to-analog) converter.

The apparatus of the present invention is much like the system described in U.S. Pat. No. 4,509,043 for performing index operations, and the description of that system applies as well to the present apparatus. However, in the performing of true color operations in and color map memory of the present apparatus are designed to operate differently from said system, as described below.

Figure 5:
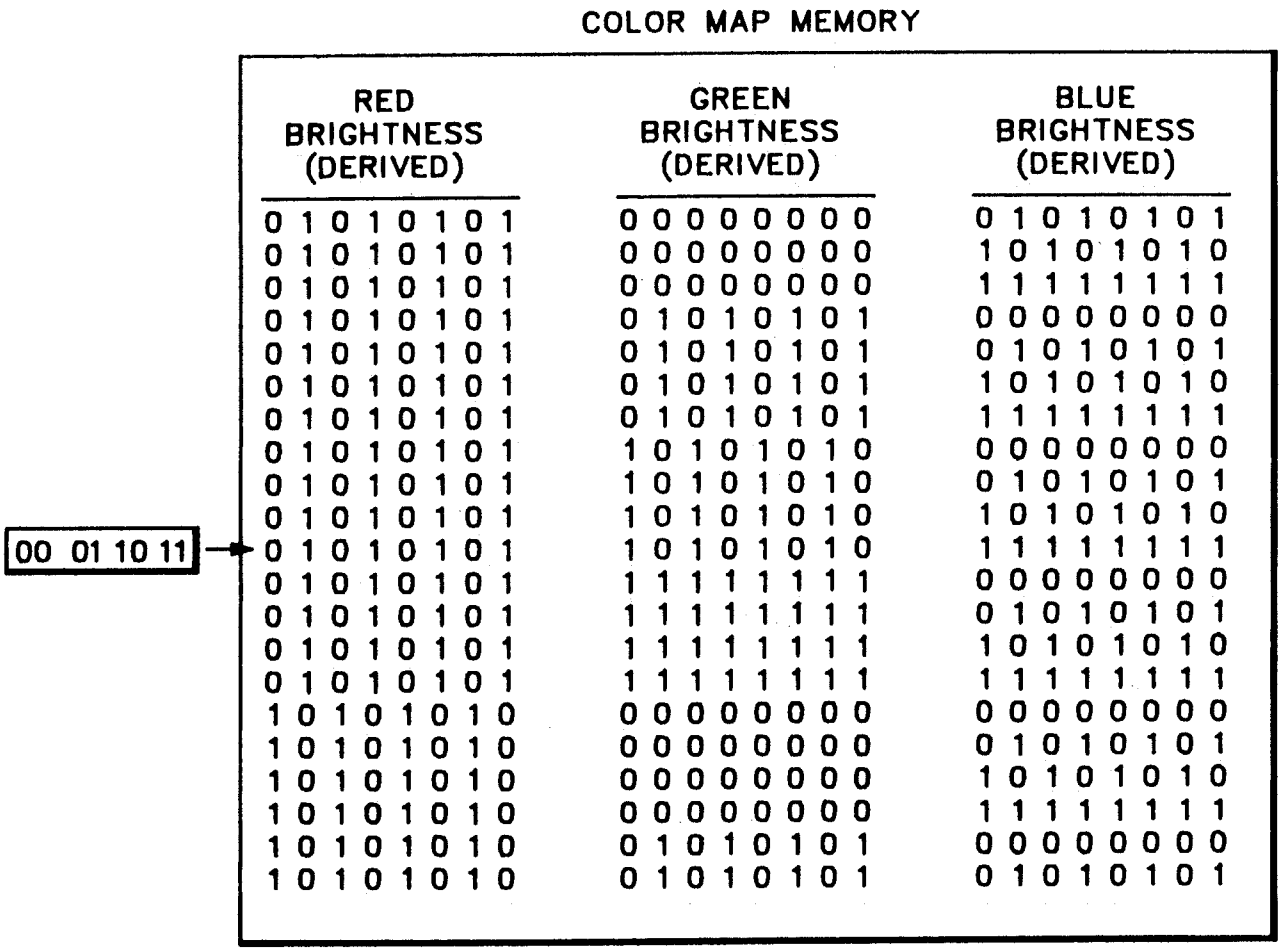
FIG. 5 is a block diagram showing a color map memory of the apparatus of FIG. 4.

FIG. 5 shows color map memory 22 of the present apparatus in greater detail. Like the prior art, the RGB values are arranged in tabular form in memory, with each memory location containing one set of R,G, and B values addressable by a single address. Unlike the prior art, the RGB values in the tables are calculated (derived) by the apparatus from data supplied to the apparatus. The calculation is performed by processor 12 under control of the stored program. (Examples of the stored program are presented in Appendixes A and B.) Also unlike the prior art, the single address used to reference the RGB values in the table is derived by processor 12 of the apparatus from RGB values specified by the user. Thus, in the present invention, both the RGB table values and the single address for referencing the RGB table values are derived by the apparatus.

The initial user of the apparatus (e.g., the supplier of the apparatus) specifies the RGB color values to be used in populating the table, by uniformly quantizing the closed interval from zero to one for each color. For example, the user may specify the number of the displayable levels to be Q (i.e., Q discrete quantization levels of red, green, and blue displayable primary colors). Thereafter, the apparatus calculates the actual table entries (i.e., the true-color RGB values which, when referenced subsequently by a single index-type address, produces the original user-specified values).

As shown in Table I, one set of displayable primary color levels may be:

TABLE I

| | Quantization Level | Displayable Primary Color Levels | | |
|---|---|---|---|---|
| | | R | G | B |
| Number (Q) of Quantization Levels = 5 | 0 | 0 | 0 | 0 |
| | 1 | .25 | .25 | .25 |
| | 2 | .5 | .5 | .5 |
| | 3 | .75 | .75 | .75 |
| | 4 | 1 | 1 | 1 |

The five quantization levels occupy the range from 0% to 100% of displayable red, green, and blue primary colors.

Figure 6:
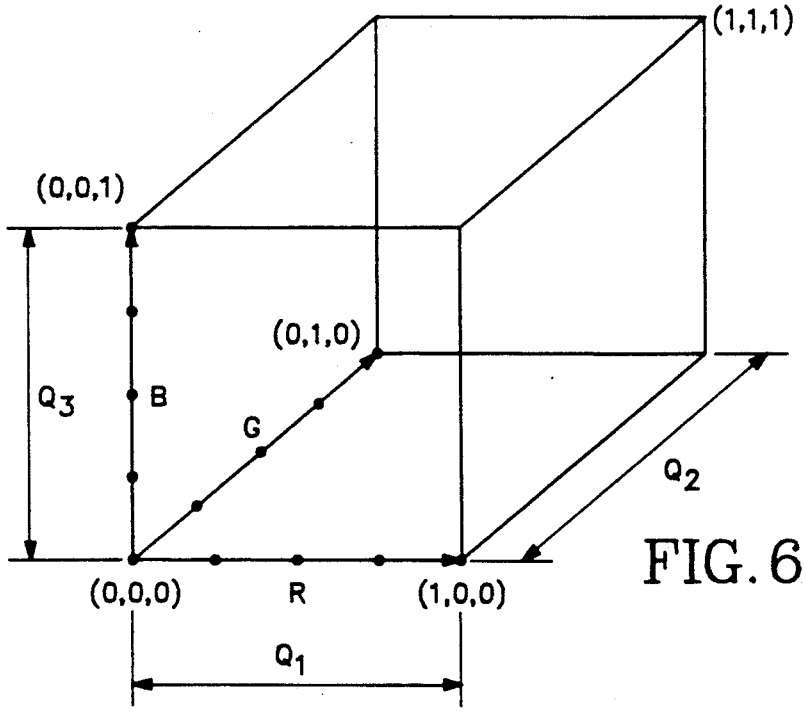
FIG. 6 is a block diagram showing the range of displayable colors as a three-dimensional color coordinate space.

As shown in FIG. 6, the range of displayable colors may be viewed as a three-dimensional color space, where (9,0,0) represents black, i.e., 0% red, 0% green, 0% blue, (1,0,0) represents 100% red, (0,1,0) represents 100% green, (0,0,1) represents 100% blue, and (1,1,1) represents white, i.e., 100% red, 100% green and 100% blue.

As shown in FIG. 6, the user of the apparatus may select:

$Q_1$ levels of Red
$Q_2$ levels of Green
$Q_3$ levels of Blue when representing a true-color object within in limits of the displayable colors of the apparatus. From the displayable levels specified by the user, the apparatus derives (calculates) color values suitable for single index referencing (single addressing), and stores the derived values in tables in memory for later use.

The apparatus calculates the color values (table entries) and populates the RGB tables as follows:

$$\text{Red (address)} = i/(Q_1 - 1)$$

$$\text{Green (address)} = j/(Q_2 - 1)$$

$$\text{Blue (address)} = k/(Q_3 - 1)$$

where: $Q_1$ represents the number of quantization levels specified for red
$Q_2$ represents the number of quantization levels specified for green
$Q_3$ represents the number of quantization levels specified for blue
quantization level $i=0$ to $Q_1-1$
quantization level $j=0$ to $Q_2-1$
quantization level $k=0$ to $Q_3-1$
address $= i + Q_1 j + Q_1 Q_2 k$
n represents the number of permissible table entries and $(Q_1 \times Q_2 \times Q_3) < n$.
or $Q_1 \times Q_2 \times Q_3 \leqq w^m$, where m represents the number of bit planes, as shown for example in FIGS. 2 and 8.

The following RGB tables show color data produced (derived) by processor 12 in response to user-specified quantization levels. Processor 12 stores the derived data in memory 22 in a predetermined sequence (arrangement), as shown in Table II below.

TABLE II

| Specified Color Values | Derived Single Address | Derived & Stored Color Data | | |
|---|---|---|---|---|
| | | R | G | B |
| (0,0,0) | 0 | 0 | 0 | 0 |
| (.25,0,0) | 1 | .25 | 0 | 0 |
| (.5,0,0) | 2 | .5 | 0 | 0 |
| | | .75 | 0 | 0 |
| | | 1 | 0 | 0 |
| • | • | 0 | .25 | 0 |
| | | .25 | .25 | 0 |
| | | .5 | .25 | 0 |
| | | .75 | .25 | 0 |
| | | 1 | .25 | 0 |
| • | • | 0 | .5 | 0 |
| | | .25 | .5 | 0 |
| | | .5 | .5 | 0 |
| | | .75 | .5 | 0 |
| | | 1 | .5 | 0 |
| | | 0 | .75 | 0 |
| • | • | .25 | .75 | 0 |
| | | .5 | .75 | 0 |
| | | .75 | .75 | 0 |
| | | 1 | .75 | 0 |
| | | 0 | 1 | 0 |
| | | .25 | 1 | 0 |
| (.5,1,0) | 22 | .5 | 1 | 0 |
| (.75,1,0) | 23 | .75 | 1 | 0 |
| (1,1,0) | 24 | 1 | 1 | 0 |
| (0,0,.25) | 25 | 0 | 0 | .25 |
| (.25,0,.25) | 26 | .25 | 0 | .25 |
| | | .5 | 0 | .25 |
| | | .75 | 0 | .25 |
| | | 1 | 0 | .25 |
| | | 0 | .25 | .25 |
| • | • | .25 | .25 | .25 |
| | | .5 | .25 | .25 |
| | | .75 | .25 | .25 |

TABLE II-continued

| Specified Color Values | Derived Single Address | Derived & Stored Color Data R | G | B |
|---|---|---|---|---|
| | | 1 | .25 | .25 |
| | | 0 | .5 | .25 |
| • | • | .25 | .5 .25 | |
| | | .5 | .5 | .25 |
| | | .75 | .5 | .25 |
| | | 1 | .5 | .25 |
| | | 0 | .75 | .25 |
| | | .25 | .75 | .25 |
| | | .5 | .75 | .25 |
| • | • | .75 | .75 | .25 |
| | | 1 | .75 | .25 |
| | | 0 | 1 | .25 |
| | | .25 | 1 | .25 |
| | | .5 | 1 | .25 |
| (.75,1,.25) | 48 | .75 | 1 | .25 |
| (1,1,.25) | 49 | 1 | 1 | .25 |
| (0,0,.5) | 50 | 0 | 0 | .5 |
| (.25,0,.5) | 51 | .25 | 0 | .5 |
| | | .5 | 0 | .5 |
| | | .75 | 0 | .5 |
| | | 1 | 0 | .5 |
| • | • | 0 | .25 | .5 |
| | | .25 | .25 | .5 |
| | | .5 | .25 | .5 |
| | | .75 | .25 | .5 |
| | | 1 | .25 | .5 |
| • | • | 0 | .5 | .5 |
| | | .25 | .5 | .5 |
| | | .5 | .5 | .5 |
| | | .75 | .5 | .5 |
| | | 1 | .5 | .5 |
| | | 0 | .75 | .5 |
| | | .25 | .75 | .5 |
| • | • | .5 | .75 | .5 |
| | | .75 | .75 | .5 |
| | | 1 | .75 | .5 |
| | | 0 | 1 | .5 |
| | | .25 | 1 | .5 |
| | | .5 | 1 | .5 |
| (.75,1,.5) | 73 | .75 | 1 | .5 |
| (1,1,.5) | 74 | 1 | 1 | .5 |
| (0,0,.75) | 75 | 0 | 0 | .75 |
| (.25,0,.75) | 76 | .25 | 0 | .75 |
| | | .5 | 0 | .75 |
| | | .75 | 0 | .75 |
| | | 1 | 0 | .75 |
| | | 0 | .25 | .75 |
| • | • | .25 | .25 | .75 |
| | | .5 | .25 | .75 |
| | | .75 | .25 | .75 |
| | | 1 | .25 | .75 |
| | | 0 | .5 | .75 |
| (.25,.5,.75) | 86 | .25 | .5 | .75 |
| | | .5 | .5 | .75 |
| | | .75 | .5 | .75 |
| | | 1 | .5 | .75 |
| | | 0 | .75 | .75 |
| | | .25 | .75 | .75 |
| • | • | .5 | .75 | .75 |
| | | .75 | .75 | .75 |
| | | 1 | .75 | .75 |
| | | 0 | 1 | .75 |
| | | .25 | 1 | .75 |
| | | .5 | 1 | .75 |
| (.75,1,.75) | 98 | .75 | 1 | .75 |
| (1,1,.75) | 99 | 1 | 1 | .75 |
| (0,0,1) | 100 | 0 | 0 | 1 |
| (.25,0,1) | 101 | .25 | 0 | 1 |
| | | .5 | 05 | 1 |
| | | .75 | .0 | 1 |
| | | 1 | 0 | 1 |
| • | • | 0 | .25 | 1 |
| | | .25 | .25 | 1 |
| | | .5 | .25 | 1 |
| • | • | .75 | .25 | 1 |
| | | 1 | .25 | 1 |
| | | 0 | .5 | 1 |
| • | • | .25 | .5 | 1 |

TABLE II-continued

| Specified Color Values | Derived Single Address | Derived & Stored Color Data R | G | B |
|---|---|---|---|---|
| | | .5 | .5 | 1 |
| | | .75 | .5 | 1 |
| | | 1 | .5 | 1 |
| | | 0 | .75 | 1 |
| | | .25 | .75 | 1 |
| • | • | .5 | .75 | 1 |
| | | .75 | .75 | 1 |
| | | 1 | .75 | 1 |
| • | • | 0 | 1 | 1 |
| | | .25 | 1 | 1 |
| | | .5 | 1 | 1 |
| (.75,1,1) | 123 | .75 | 1 | 1 |
| (1,1,1) | 124 | 1 | 1 | 1 |

The sequence in which the data is stored in memory 22 ensures that, from the RGB values specified by the user, the processor 12 will derive the appropriate index (single address) for referencing the correct RGB values in memory 22. Processor 12 derives each single address (index) by means of the following formula:

$$\text{Index} = [R\,(Q_1 - 1)]\ \text{rounded} + Q_1\,[G\,(Q_2 - 1)]\ \text{rounded} + Q_1\,Q_2\,[B\,(Q_3 - 1)]\ \text{rounded.}$$

Thus, as shown in Table II above, from the three-dimensional true color value (0.25, 0.5, 0.75) specified by the user, the address 86 would be derived by processor 12, permitting access to the correct RGB values in the table.

Figure 7:
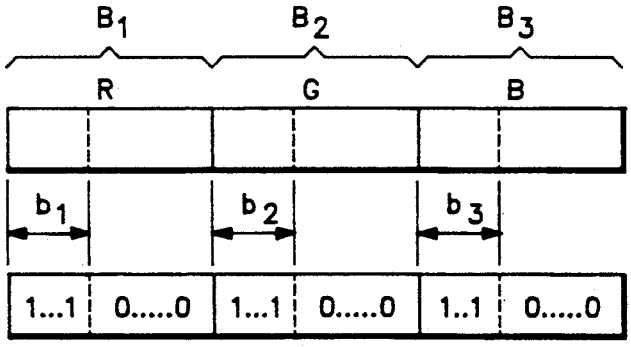
FIG. 7 is a block diagram of a concatenation mask used in the apparatus of FIG. 4.
Figure 8:
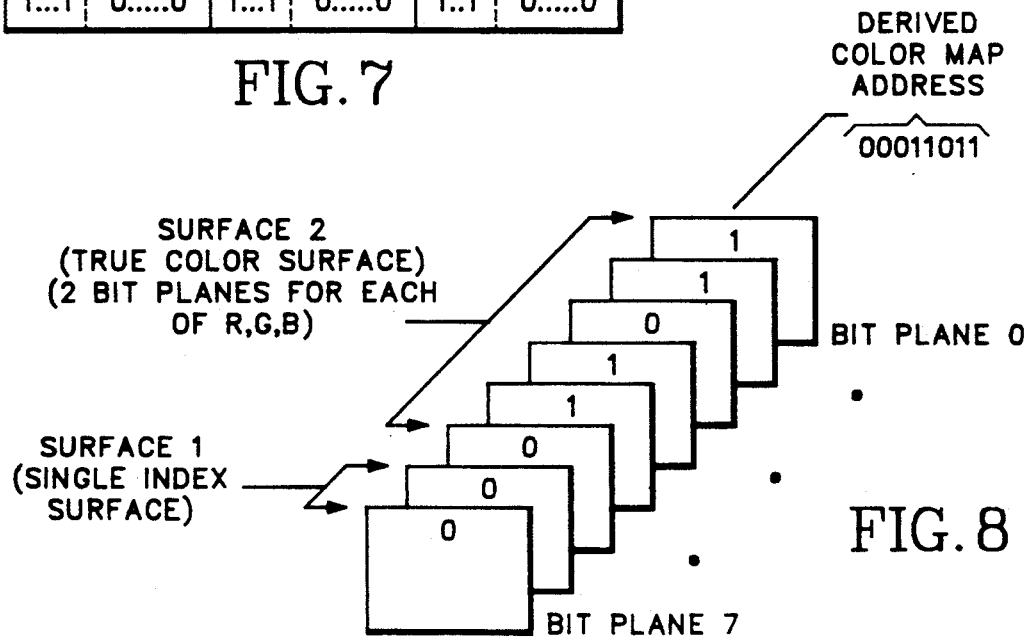
FIG. 8 is a block diagram showing multiple bit planes, a true color surface and a single index surface.

An alternative formula for deriving single addresses (indexes) from specified (input) RGB values is:

$$[^{R}Q_1]\text{truncated} + Q_1[^{G}Q_2]\text{truncated} + Q_1Q_2[^{B}Q_3]\text{truncated}$$

where:

$0 \leqq R < 1;\ 0 \leqq G < 1;\ 0 \leqq B < 1$ and $Q_1$, $Q_2$, $Q_3$, are powers of two Given $B_1$ bits of red, $B_2$ bit of green and $B_3$ bits of blue, and given an m-bit plane surface, as shown for example in FIG. 8, where $m = b_1 + b_2 + b_3$ and $b_1 \leqq B_1$, $b_2 \leqq B_2$, $b_3 \leqq B_3$, then the above-mentioned truncation operation may be performed as shown in FIG. 7, where the $b_1$ most significant bits (MSB) of the R field, and the $b_2$ MSB of the G field, and the $b_3$ MSB of the B field, are concatenated, and shifted to align it with the m-bit plaue surface.

In the foregoing, the method for converting from true color data to single index data is described. The method includes the steps of deriving true color data (i.e., RGB color level values) from the number of color levels specified by the user, storing the derived data in memory in predetermined arrangement suitable for referencing by a single address or index, and deriving from user-supplied RGB color values a single address for referencing the stored data.

Appendix A shows RGB values, and associated single index addresses, derived for:

$Q_1 = 5$ red levels $Q_2 = 5$ green levels $Q_3 = 5$ blue levels, the RGB values being in the range 0 to 255, representing 0% to 100%.

Appendix B shows RGB values, and associated single index addresses, derived for:

$Q_1=7$ red levels $Q_2=6$ green levels $Q_3=5$ blue levels, the RGB values being in the range 0 to 255, representing 0% to 100%.

In appendix C below, index and true color data (stored in binary form in color map memory 22) are shown for both a single index surface (surface 1) and a true color surface 2). For example, of the address "00 01 10 11" shown in Appendix C and in FIG. 8, the "00" represents a color index for surface 1, and the "01 10 11" represents RGB color values for surface 2. The address was computed (derived) from user-supplied index and true color values. The address is used to reference the RGB values "01010101 10101010 11111111".

Depending on which surface has a priority over the other, the RGB values may differ for a given address. For example, given the computer address "01 11 11 11", if the RGB values "10000000 10000000 10000000" has been predetermined to represent the color index "01", and the RGB values "11111111 11111111 11111111" has been predetermined to represent the RGB color level "11 11 11", then the RGB values "10000000 10000000 10000000" would be used if the indexed color surface had priority, and the RGB values "11111111 11111111 11111111" would be used if the true color surface had priority.

APPENDIX A
(PROGRAM LISTING/DATA/COMMENTS)

```
/* global type and data declarations */

typedef struct {
  unsigned char R, G, B;
} table_entry_t; /* "unsigned char" data is 8 bits in length */

/* In the invention, variables q1, q2, and q3 are set in
   in response to a user command or set to default values
   by the system. */

int q1; /* number of quanta of red */
int q2; /* number of quanta of green */
int q3; /* number of quanta of blue */

#include "tc_utils.c" /* the "populate" and "convert" functions */

/*************************************************************************/

/* The following test program calls the "populate" and "convert"
   functions and prints their results for some example cases */

main()
{
  table_entry_t array[5*5*5];
  int i;

  q1 = 5; /* number of red quantum levels */
  q2 = 5; /* number of green quantum levels */
  q3 = 5; /* number of blue quantum levels */

  populate(array);

  for(i=0; i <= 5*5*5-1; ++i)
    printf ("%d:\t%d\t%d\t%d\n", i,
            (int)array[i].R, (int)array[i].G, (int)array[i].B);

  printf("%d\n",convert(0.0, 0.0, 0.0));
  printf("%d\n",convert(0.0, 0.0, 0.25));
  printf("%d\n",convert(0.0, 0.0, 0.5));
  printf("%d\n",convert(0.0, 0.0, 0.75));
  printf("%d\n",convert(0.0, 0.0, 1.0));
  printf("%d\n",convert(0.0, 0.25, 0.0));
  printf("%d\n",convert(0.0, 0.5, 0.0));
  printf("%d\n",convert(0.0, 0.75, 0.0));
  printf("%d\n",convert(0.0, 1.0, 0.0));
  printf("%d\n",convert(0.25, 0.0, 0.0));
  printf("%d\n",convert(0.5, 0.0, 0.0));
```

```
  printf("%d\n",convert(0.75, 0.0, 0.0));
  printf("%d\n",convert(1.0, 0.0, 0.0));
}

/*************************************************************************/

/* populate.c -- example color-map population function.  This function
   computes "surface color-map" (per Mossaides) data for simulating true
   color, and stores the data in a main-memory array of RGB values.  The
   location of the array is passed into this function as an argument.

   This function is called in response to a user command to create a
   "true-color surface."

   After this function has been called, the array can be copied into
   the hardware color map, or combined with other "surface color maps" as
   per Mossaides, and the combined map copied into the hardware color
   map.  The hardware color map is assumed to hold 8 bits each for red,
   green, and blue entries at each address.

   Note that the computation of the address shown below is only one
   example; another equally valid example would have address = i*q2*q3
   + j*q3 + k; and others are possible. The only requirement is that the
   same rule be used to compute the addresss in this function and to compute
   the index in the "convert" function. */

populate(table)
     table_entry_t *table; /* pointer to color table array
                              in main memory */
{
  int i; /* red quantum number */
  int j; /* green quantum number */
  int k; /* blue quantum number */
  int address;
  double red_value, green_value, blue_value;

  /* loop for all possible sets of quanta */
  for (i=0; i <= q1-1; ++i)      /* all the red quanta */
    for (j=0; j <= q2-1; ++j)    /* all the green quanta */
      for (k=0; k <= q3-1; ++k) /* all the blue quanta */

        /* do the following for each set of quanta */
        {
          /* compute an array address corresponding to
             the current set of quanta */

          address = i + q1*j + q1*q2*k;

          /* compute the "ideal" primary levels from the
             quantum numbers and the maximum quantum numbers */

          red_value   = (double)i/(double)(q1-1);
          green_value = (double)j/(double)(q2-1);
          blue_value  = (double)k/(double)(q3-1);

          /* convert the "ideal" primary levels (real numbers
             from 0.0 to 1.0) to "actual" primary levels (unsigned
             chars ranging from 0 to 255) and store them in the array,
             by scaling and rounding */

          table[address].R = (unsigned char)(255 * red_value + 0.5);
          table[address].G = (unsigned char)(255 * green_value + 0.5);
          table[address].B = (unsigned char)(255 * blue_value + 0.5);

        } /* end of loop body */
}

/*************************************************************************/
```

```
/* convert.c -- this function takes as input three real numbers R, G,
   and B (on the range 0.0 to 1.0) representing the color of a pixel, and
   produces a single color index to be stored at that pixel's location in
   the frame buffer.  This function is used during the course of drawing
   image segments into the frame buffer. */

convert(r, g, b)
     double r, g, b;
{
  int i, j, k;

  /* compute quantum numbers of nearest available RGB values */
  i = (int)(r * (q1-1) + 0.5); /* red quantum number */
  j = (int)(g * (q2-1) + 0.5); /* green quantum number */
  k = (int)(b * (q3-1) + 0.5); /* blue quantum number */

  /* Combine the quantum numbers into an index according to
     the same rule as is used for computing the address variable
     in the "populate" function.  Return the index as a value
     to the caller of the "convert" function.

     The caller can subsequently write the computed index into
     the frame buffer, when it wants to simulate writing color (r,g,b)
     at one or more pixel locations the frame buffer. */

  return (i + q1*j + q1*q2*k);

}
```

| | | | |
|---|---|---|---|
| 0: | 0 | 0 | 0 |
| 1: | 64 | 0 | 0 |
| 2: | 128 | 0 | 0 |
| 3: | 191 | 0 | 0 |
| 4: | 255 | 0 | 0 |
| 5: | 0 | 64 | 0 |
| 6: | 64 | 64 | 0 |
| 7: | 128 | 64 | 0 |
| 8: | 191 | 64 | 0 |
| 9: | 255 | 64 | 0 |
| 10: | 0 | 128 | 0 |
| 11: | 64 | 128 | 0 |
| 12: | 128 | 128 | 0 |
| 13: | 191 | 128 | 0 |
| 14: | 255 | 128 | 0 |
| 15: | 0 | 191 | 0 |
| 16: | 64 | 191 | 0 |
| 17: | 128 | 191 | 0 |
| 18: | 191 | 191 | 0 |
| 19: | 255 | 191 | 0 |
| 20: | 0 | 255 | 0 |
| 21: | 64 | 255 | 0 |
| 22: | 128 | 255 | 0 |
| 23: | 191 | 255 | 0 |
| 24: | 255 | 255 | 0 |
| 25: | 0 | 0 | 64 |
| 26: | 64 | 0 | 64 |
| 27: | 128 | 0 | 64 |
| 28: | 191 | 0 | 64 |
| 29: | 255 | 0 | 64 |
| 30: | 0 | 64 | 64 |
| 31: | 64 | 64 | 64 |
| 32: | 128 | 64 | 64 |
| 33: | 191 | 64 | 64 |
| 34: | 255 | 64 | 64 |
| 35: | 0 | 128 | 64 |
| 36: | 64 | 128 | 64 |
| 37: | 128 | 128 | 64 |
| 38: | 191 | 128 | 64 |
| 39: | 255 | 128 | 64 |

| | | | |
|---|---|---|---|
| 40: | 0 | 191 | 64 |
| 41: | 64 | 191 | 64 |
| 42: | 128 | 191 | 64 |
| 43: | 191 | 191 | 64 |
| 44: | 255 | 191 | 64 |
| 45: | 0 | 255 | 64 |
| 46: | 64 | 255 | 64 |
| 47: | 128 | 255 | 64 |
| 48: | 191 | 255 | 64 |
| 49: | 255 | 255 | 64 |
| 50: | 0 | 0 | 128 |
| 51: | 64 | 0 | 128 |
| 52: | 128 | 0 | 128 |
| 53: | 191 | 0 | 128 |
| 54: | 255 | 0 | 128 |
| 55: | 0 | 64 | 128 |
| 56: | 64 | 64 | 128 |
| 57: | 128 | 64 | 128 |
| 58: | 191 | 64 | 128 |
| 59: | 255 | 64 | 128 |
| 60: | 0 | 128 | 128 |
| 61: | 64 | 128 | 128 |
| 62: | 128 | 128 | 128 |
| 63: | 191 | 128 | 128 |
| 64: | 255 | 128 | 128 |
| 65: | 0 | 191 | 128 |
| 66: | 64 | 191 | 128 |
| 67: | 128 | 191 | 128 |
| 68: | 191 | 191 | 128 |
| 69: | 255 | 191 | 128 |
| 70: | 0 | 255 | 128 |
| 71: | 64 | 255 | 128 |
| 72: | 128 | 255 | 128 |
| 73: | 191 | 255 | 128 |
| 74: | 255 | 255 | 128 |
| 75: | 0 | 0 | 191 |
| 76: | 64 | 0 | 191 |
| 77: | 128 | 0 | 191 |
| 78: | 191 | 0 | 191 |
| 79: | 255 | 0 | 191 |
| 80: | 0 | 64 | 191 |
| 81: | 64 | 64 | 191 |
| 82: | 128 | 64 | 191 |
| 83: | 191 | 64 | 191 |
| 84: | 255 | 64 | 191 |
| 85: | 0 | 128 | 191 |
| 86: | 64 | 128 | 191 |
| 87: | 128 | 128 | 191 |
| 88: | 191 | 128 | 191 |
| 89: | 255 | 128 | 191 |
| 90: | 0 | 191 | 191 |
| 91: | 64 | 191 | 191 |
| 92: | 128 | 191 | 191 |
| 93: | 191 | 191 | 191 |
| 94: | 255 | 191 | 191 |
| 95: | 0 | 255 | 191 |
| 96: | 64 | 255 | 191 |
| 97: | 128 | 255 | 191 |
| 98: | 191 | 255 | 191 |
| 99: | 255 | 255 | 191 |
| 100: | 0 | 0 | 255 |
| 101: | 64 | 0 | 255 |
| 102: | 128 | 0 | 255 |
| 103: | 191 | 0 | 255 |
| 104: | 255 | 0 | 255 |
| 105: | 0 | 64 | 255 |
| 106: | 64 | 64 | 255 |
| 107: | 128 | 64 | 255 |
| 108: | 191 | 64 | 255 |
| 109: | 255 | 64 | 255 |

```
110:    0       128     255
111:    64      128     255
112:    128     128     255
113:    191     128     255
114:    255     128     255
115:    0       191     255
116:    64      191     255
117:    128     191     255
118:    191     191     255
119:    255     191     255
120:    0       255     255
121:    64      255     255
122:    128     255     255
123:    191     255     255
124:    255     255     255
0
25
50
75
100
5
10
15
20
1
2
3
4
```

APPENDIX B (Program Listing/Data/Comments)

```
/* global type and data declarations */

typedef struct {
  unsigned char R, G, B;
} table_entry_t; /* "unsigned char" data is 8 bits in length */

/* In the invention, variables q1, q2, and q3 are set in
   in response to a user command or set to default values
   by the system. */

int q1; /* number of quanta of red */
int q2; /* number of quanta of green */
int q3; /* number of quanta of blue */

#include "tc_utils.c" /* the "populate" and "convert" functions */

/*************************************************************************/

/* The following test program calls the "populate" and "convert"
   functions and prints their results for some example cases */

main()
{
  table_entry_t array[7*6*5];
  int i;

  q1 = 7; /* number of red quantum levels */
  q2 = 6; /* number of green quantum levels */
  q3 = 5; /* number of blue quantum levels */

  populate(array);

  for(i=0; i <= 7*6*5-1; ++i)
    printf ("%d:\t%d\t%d\t%d\n", i,
            (int)array[i].R,(int)array[i].G,(int)array[i].B);
```

```
  printf("%d\n",convert(0.0, 0.0, 0.0));
  printf("%d\n",convert(0.0, 0.0, 0.25));
  printf("%d\n",convert(0.0, 0.0, 0.5));
  printf("%d\n",convert(0.0, 0.0, 0.75));
  printf("%d\n",convert(0.0, 0.0, 1.0));
  printf("%d\n",convert(0.0, 0.2, 0.0));
  printf("%d\n",convert(0.0, 0.4, 0.0));
  printf("%d\n",convert(0.0, 0.6, 0.0));
  printf("%d\n",convert(0.0, 0.8, 0.0));
  printf("%d\n",convert(0.1666667, 0.0, 0.0));
  printf("%d\n",convert(0.3333333, 0.0, 0.0));
  printf("%d\n",convert(0.5000000, 0.0, 0.0));
  printf("%d\n",convert(0.6666667, 0.0, 0.0));
  printf("%d\n",convert(0.8333333, 0.0, 0.0));
}

/*************************************************************************/

/* populate.c -- example color-map population function.  This function
   computes "surface color-map" (per Mossaides) data for simulating true
   color, and stores the data in a main-memory array of RGB values.  The
   location of the array is passed into this function as an argument.

   This function is called in response to a user command to create a
   "true-color surface."

   After this function has been called, the array can be copied into
   the hardware color map, or combined with other "surface color maps" as
   per Mossaides, and the combined map copied into the hardware color
   map.  The hardware color map is assumed to hold 8 bits each for red,
   green, and blue entries at each address.

   Note that the computation of the address shown below is only one
   example; another equally valid example would have address = i + q1*j +
   q1*q2*k and others are possible. The only requirement is that the same
   rule be used to compute the addresss in this function and to compute
   the index in the "convert" function. */

populate(table)
     table_entry_t *table; /* pointer to color table array
                              in main memory */
{
  int i; /* red quantum number */
  int j; /* green quantum number */
  int k; /* blue quantum number */
  int address;
  double red_value, green_value, blue_value;

  /* loop for all possible sets of quanta */
  for (i=0; i <= q1-1; ++i)      /* all the red quanta */
    for (j=0; j <= q2-1; ++j)    /* all the green quanta */
      for (k=0; k <= q3-1; ++k) /* all the blue quanta */

        /* do the following for each set of quanta */
        {
          /* compute an array address corresponding to
             the current set of quanta */

          address      = i*q2*q3 + j*q3 + k;

          /* compute the "ideal" primary levels from the
             quantum numbers and the maximum quantum numbers */

          red_value   = (double)i/(double)(q1-1);
          green_value = (double)j/(double)(q2-1);
          blue_value  = (double)k/(double)(q3-1);

          /* convert the "ideal" primary levels (real numbers
             from 0.0 to 1.0) to "actual" primary levels (unsigned
```

```
            chars ranging from 0 to 255) and store them in the array,
            by scaling and rounding */

          table[address].R = (unsigned char)(255 * red_value + 0.5);
          table[address].G = (unsigned char)(255 * green_value + 0.5);
          table[address].B = (unsigned char)(255 * blue_value + 0.5);

        } /* end of loop body */
}

/*************************************************************************/


/* convert.c -- this function takes as input three real numbers R, G,
   and B (on the range 0.0 to 1.0) representing the color of a pixel, and
   produces a single color index to be stored at that pixel's location in
   the frame buffer.  This function is used during the course of drawing
   image segments into the frame buffer. */

convert(r, g, b)
    double r, g, b;
{
  int i, j, k;

  /* compute quantum numbers of nearest available RGB values */
  i = (int)(r * (q1-1) + 0.5); /* red quantum number */
  j = (int)(g * (q2-1) + 0.5); /* green quantum number */
  k = (int)(b * (q3-1) + 0.5); /* blue quantum number */

  /* Combine the quantum numbers into an index according to
     the same rule as is used for computing the address variable
     in the "populate" function.  Return the index as a value
     to the caller of the "convert" function.

     The caller can subsequently write the computed index into
     the frame buffer, when it wants to simulate writing color (r,g,b)
     at one or more pixel locations the frame buffer. */

  return (i*q2*q3 + j*q3 + k);
}

0:      0       0       0
1:      0       0       64
2:      0       0       128
3:      0       0       191
4:      0       0       255
5:      0       51      0
6:      0       51      64
7:      0       51      128
8:      0       51      191
9:      0       51      255
10:     0       102     0
11:     0       102     64
12:     0       102     128
13:     0       102     191
14:     0       102     255
15:     0       153     0
16:     0       153     64
17:     0       153     128
18:     0       153     191
19:     0       153     255
20:     0       204     0
21:     0       204     64
22:     0       204     128
23:     0       204     191
24:     0       204     255
25:     0       255     0
26:     0       255     64
27:     0       255     128
```

| | | | |
|---|---|---|---|
| 28: | 0 | 255 | 191 |
| 29: | 0 | 255 | 255 |
| 30: | 43 | 0 | 0 |
| 31: | 43 | 0 | 64 |
| 32: | 43 | 0 | 128 |
| 33: | 43 | 0 | 191 |
| 34: | 43 | 0 | 255 |
| 35: | 43 | 51 | 0 |
| 36: | 43 | 51 | 64 |
| 37: | 43 | 51 | 128 |
| 38: | 43 | 51 | 191 |
| 39: | 43 | 51 | 255 |
| 40: | 43 | 102 | 0 |
| 41: | 43 | 102 | 64 |
| 42: | 43 | 102 | 128 |
| 43: | 43 | 102 | 191 |
| 44: | 43 | 102 | 255 |
| 45: | 43 | 153 | 0 |
| 46: | 43 | 153 | 64 |
| 47: | 43 | 153 | 128 |
| 48: | 43 | 153 | 191 |
| 49: | 43 | 153 | 255 |
| 50: | 43 | 204 | 0 |
| 51: | 43 | 204 | 64 |
| 52: | 43 | 204 | 128 |
| 53: | 43 | 204 | 191 |
| 54: | 43 | 204 | 255 |
| 55: | 43 | 255 | 0 |
| 56: | 43 | 255 | 64 |
| 57: | 43 | 255 | 128 |
| 58: | 43 | 255 | 191 |
| 59: | 43 | 255 | 255 |
| 60: | 85 | 0 | 0 |
| 61: | 85 | 0 | 64 |
| 62: | 85 | 0 | 128 |
| 63: | 85 | 0 | 191 |
| 64: | 85 | 0 | 255 |
| 65: | 85 | 51 | 0 |
| 66: | 85 | 51 | 64 |
| 67: | 85 | 51 | 128 |
| 68: | 85 | 51 | 191 |
| 69: | 85 | 51 | 255 |
| 70: | 85 | 102 | 0 |
| 71: | 85 | 102 | 64 |
| 72: | 85 | 102 | 128 |
| 73: | 85 | 102 | 191 |
| 74: | 85 | 102 | 255 |
| 75: | 85 | 153 | 0 |
| 76: | 85 | 153 | 64 |
| 77: | 85 | 153 | 128 |
| 78: | 85 | 153 | 191 |
| 79: | 85 | 153 | 255 |
| 80: | 85 | 204 | 0 |
| 81: | 85 | 204 | 64 |
| 82: | 85 | 204 | 128 |
| 83: | 85 | 204 | 191 |
| 84: | 85 | 204 | 255 |
| 85: | 85 | 255 | 0 |
| 86: | 85 | 255 | 64 |
| 87: | 85 | 255 | 128 |
| 88: | 85 | 255 | 191 |
| 89: | 85 | 255 | 255 |
| 90: | 128 | 0 | 0 |
| 91: | 128 | 0 | 64 |
| 92: | 128 | 0 | 128 |
| 93: | 128 | 0 | 191 |
| 94: | 128 | 0 | 255 |
| 95: | 128 | 51 | 0 |
| 96: | 128 | 51 | 64 |

| | | | |
|---|---|---|---|
| 97: | 128 | 51 | 128 |
| 98: | 128 | 51 | 191 |
| 99: | 128 | 51 | 255 |
| 100: | 128 | 102 | 0 |
| 101: | 128 | 102 | 64 |
| 102: | 128 | 102 | 128 |
| 103: | 128 | 102 | 191 |
| 104: | 128 | 102 | 255 |
| 105: | 128 | 153 | 0 |
| 106: | 128 | 153 | 64 |
| 107: | 128 | 153 | 128 |
| 108: | 128 | 153 | 191 |
| 109: | 128 | 153 | 255 |
| 110: | 128 | 204 | 0 |
| 111: | 128 | 204 | 64 |
| 112: | 128 | 204 | 128 |
| 113: | 128 | 204 | 191 |
| 114: | 128 | 204 | 255 |
| 115: | 128 | 255 | 0 |
| 116: | 128 | 255 | 64 |
| 117: | 128 | 255 | 128 |
| 118: | 128 | 255 | 191 |
| 119: | 128 | 255 | 255 |
| 120: | 170 | 0 | 0 |
| 121: | 170 | 0 | 64 |
| 122: | 170 | 0 | 128 |
| 123: | 170 | 0 | 191 |
| 124: | 170 | 0 | 255 |
| 125: | 170 | 51 | 0 |
| 126: | 170 | 51 | 64 |
| 127: | 170 | 51 | 128 |
| 128: | 170 | 51 | 191 |
| 129: | 170 | 51 | 255 |
| 130: | 170 | 102 | 0 |
| 131: | 170 | 102 | 64 |
| 132: | 170 | 102 | 128 |
| 133: | 170 | 102 | 191 |
| 134: | 170 | 102 | 255 |
| 135: | 170 | 153 | 0 |
| 136: | 170 | 153 | 64 |
| 137: | 170 | 153 | 128 |
| 138: | 170 | 153 | 191 |
| 139: | 170 | 153 | 255 |
| 140: | 170 | 204 | 0 |
| 141: | 170 | 204 | 64 |
| 142: | 170 | 204 | 128 |
| 143: | 170 | 204 | 191 |
| 144: | 170 | 204 | 255 |
| 145: | 170 | 255 | 0 |
| 146: | 170 | 255 | 64 |
| 147: | 170 | 255 | 128 |
| 148: | 170 | 255 | 191 |
| 149: | 170 | 255 | 255 |
| 150: | 213 | 0 | 0 |
| 151: | 213 | 0 | 64 |
| 152: | 213 | 0 | 128 |
| 153: | 213 | 0 | 191 |
| 154: | 213 | 0 | 255 |
| 155: | 213 | 51 | 0 |
| 156: | 213 | 51 | 64 |
| 157: | 213 | 51 | 128 |
| 158: | 213 | 51 | 191 |
| 159: | 213 | 51 | 255 |
| 160: | 213 | 102 | 0 |
| 161: | 213 | 102 | 64 |
| 162: | 213 | 102 | 128 |
| 163: | 213 | 102 | 191 |
| 164: | 213 | 102 | 255 |
| 165: | 213 | 153 | 0 |

| | | | |
|---|---|---|---|
| 166: | 213 | 153 | 64 |
| 167: | 213 | 153 | 128 |
| 168: | 213 | 153 | 191 |
| 169: | 213 | 153 | 255 |
| 170: | 213 | 204 | 0 |
| 171: | 213 | 204 | 64 |
| 172: | 213 | 204 | 128 |
| 173: | 213 | 204 | 191 |
| 174: | 213 | 204 | 255 |
| 175: | 213 | 255 | 0 |
| 176: | 213 | 255 | 64 |
| 177: | 213 | 255 | 128 |
| 178: | 213 | 255 | 191 |
| 179: | 213 | 255 | 255 |
| 180: | 255 | 0 | 0 |
| 181: | 255 | 0 | 64 |
| 182: | 255 | 0 | 128 |
| 183: | 255 | 0 | 191 |
| 184: | 255 | 0 | 255 |
| 185: | 255 | 51 | 0 |
| 186: | 255 | 51 | 64 |
| 187: | 255 | 51 | 128 |
| 188: | 255 | 51 | 191 |
| 189: | 255 | 51 | 255 |
| 190: | 255 | 102 | 0 |
| 191: | 255 | 102 | 64 |
| 192: | 255 | 102 | 128 |
| 193: | 255 | 102 | 191 |
| 194: | 255 | 102 | 255 |
| 195: | 255 | 153 | 0 |
| 196: | 255 | 153 | 64 |
| 197: | 255 | 153 | 128 |
| 198: | 255 | 153 | 191 |
| 199: | 255 | 153 | 255 |
| 200: | 255 | 204 | 0 |
| 201: | 255 | 204 | 64 |
| 202: | 255 | 204 | 128 |
| 203: | 255 | 204 | 191 |
| 204: | 255 | 204 | 255 |
| 205: | 255 | 255 | 0 |
| 206: | 255 | 255 | 64 |
| 207: | 255 | 255 | 128 |
| 208: | 255 | 255 | 191 |
| 209: | 255 | 255 | 255 |

0
1
2
3
4
5
10
15
20
30
60
90
120
150

APPENDIX C (Program Listing/Data/Comments)

```
EXAMPLE SHOWING TRUE COLOR SURFACE AND INDEXED COLOR SURFACE
John C. Dalrymple
10/21/87

Assume that the indexed surface is on bit planes 7 and 6 and that the
true-color surface is on bit planes 5 down to 0, with planes 5 and 4
for red, 3 and 2 for green, and 1 and 0 for blue.
```

Assume that there are 8 bits per primary (R, G, or B) in the data fields of the hardware color map, where the bits represent fractional values with 00000000 representing 0 and 11111111 representing unity.

Assume for the example that the indexed-surface color map has been set by the user to:

| Surface index | R | G | B |
|---|---|---|---|
| 00 | (transparent) | (transparent) | (transparent) |
| 01 | 10000000 | 10000000 | 10000000 |
| 10 | 11111111 | 11111111 | 00000000 |
| 11 | 00000000 | 10000000 | 11111111 |

Assume further that the user has set the background color (behind all surfaces) to R = 0, G = 0, B = 0 (black).

---

Case 1. User has assigned higher priority to the indexed color surface.

Then the full hardware color map would be populated as:

bit numbers
76 54 32 10

| color map address | color map data R | G | B | (remarks) |
|---|---|---|---|---|
| 00 00 00 00 | 00000000 | 00000000 | 00000000 | (background color) |
| 00 00 00 01 | 00000000 | 00000000 | 01010101 | (from true-color surf |
| 00 00 00 10 | 00000000 | 00000000 | 10101010 | " |
| 00 00 00 11 | 00000000 | 00000000 | 11111111 | " |
| 00 00 01 00 | 00000000 | 01010101 | 11111111 | " |
| 00 00 01 01 | 00000000 | 01010101 | 11111111 | " |
| 00 00 01 10 | 00000000 | 01010101 | 11111111 | " |
| 00 00 01 11 | 00000000 | 01010101 | 11111111 | " |
| 00 00 10 00 | 00000000 | 10101010 | 00000000 | " |
| 00 00 10 01 | 00000000 | 10101010 | 01010101 | " |
| 00 00 10 10 | 00000000 | 10101010 | 10101010 | " |
| 00 00 10 11 | 00000000 | 10101010 | 11111111 | " |
| 00 00 11 00 | 00000000 | 11111111 | 00000000 | " |
| 00 00 11 01 | 00000000 | 11111111 | 01010101 | " |
| 00 00 11 10 | 00000000 | 11111111 | 10101010 | " |
| 00 00 11 11 | 00000000 | 11111111 | 11111111 | " |
| 00 01 00 00 | 01010101 | 00000000 | 00000000 | " |
| 00 01 00 01 | 01010101 | 00000000 | 01010101 | " |
| 00 01 00 10 | 01010101 | 00000000 | 10101010 | " |
| 00 01 00 11 | 01010101 | 00000000 | 11111111 | " |
| 00 01 01 00 | 01010101 | 01010101 | 00000000 | " |
| 00 01 01 01 | 01010101 | 01010101 | 01010101 | " |
| 00 01 01 10 | 01010101 | 01010101 | 10101010 | " |
| 00 01 01 11 | 01010101 | 01010101 | 11111111 | " |
| 00 01 10 00 | 01010101 | 10101010 | 00000000 | " |
| 00 01 10 01 | 01010101 | 10101010 | 01010101 | " |
| 00 01 10 10 | 01010101 | 10101010 | 10101010 | " |
| 00 01 10 11 | 01010101 | 10101010 | 11111111 | " |
| 00 01 11 00 | 01010101 | 11111111 | 00000000 | " |
| 00 01 11 01 | 01010101 | 11111111 | 01010101 | " |
| 00 01 11 10 | 01010101 | 11111111 | 10101010 | " |
| 00 01 11 11 | 01010101 | 11111111 | 11111111 | " |
| 00 10 00 00 | 10101010 | 00000000 | 00000000 | " |
| 00 10 00 01 | 10101010 | 00000000 | 01010101 | " |
| 00 10 00 10 | 10101010 | 00000000 | 10101010 | " |
| 00 10 00 11 | 10101010 | 00000000 | 11111111 | " |
| 00 10 01 00 | 10101010 | 01010101 | 00000000 | " |
| 00 10 01 01 | 10101010 | 01010101 | 01010101 | " |

| | | | | |
|---|---|---|---|---|
| 00 10 01 10 | 10101010 | 01010101 | 10101010 | " |
| 00 10 01 11 | 10101010 | 01010101 | 11111111 | " |
| 00 10 10 00 | 10101010 | 10101010 | 00000000 | " |
| 00 10 10 01 | 10101010 | 10101010 | 01010101 | " |
| 00 10 10 10 | 10101010 | 10101010 | 10101010 | " |
| 00 10 10 11 | 10101010 | 10101010 | 11111111 | " |
| 00 10 11 00 | 10101010 | 11111111 | 00000000 | " |
| 00 10 11 01 | 10101010 | 11111111 | 01010101 | " |
| 00 10 11 10 | 10101010 | 11111111 | 10101010 | " |
| 00 10 11 11 | 10101010 | 11111111 | 11111111 | " |
| 00 11 00 00 | 11111111 | 00000000 | 00000000 | " |
| 00 11 00 01 | 11111111 | 00000000 | 01010101 | " |
| 00 11 00 10 | 11111111 | 00000000 | 10101010 | " |
| 00 11 00 11 | 11111111 | 00000000 | 11111111 | " |
| 00 11 01 00 | 11111111 | 01010101 | 00000000 | " |
| 00 11 01 01 | 11111111 | 01010101 | 01010101 | " |
| 00 11 01 10 | 11111111 | 01010101 | 10101010 | " |
| 00 11 01 11 | 11111111 | 01010101 | 11111111 | " |
| 00 11 10 00 | 11111111 | 10101010 | 00000000 | " |
| 00 11 10 01 | 11111111 | 10101010 | 01010101 | " |
| 00 11 10 10 | 11111111 | 10101010 | 10101010 | " |
| 00 11 10 11 | 11111111 | 10101010 | 11111111 | " |
| 00 11 11 00 | 11111111 | 11111111 | 00000000 | " |
| 00 11 11 01 | 11111111 | 11111111 | 01010101 | " |
| 00 11 11 10 | 11111111 | 11111111 | 10101010 | " |
| 00 11 11 11 | 11111111 | 11111111 | 11111111 | " |
| 01 00 00 00 | 10000000 | 10000000 | 10000000 | (from indexed surfac |
| 01 00 00 01 | 10000000 | 10000000 | 10000000 | " |
| 01 00 00 10 | 10000000 | 10000000 | 10000000 | " |
| 01 00 00 11 | 10000000 | 10000000 | 10000000 | " |
| 01 00 01 00 | 10000000 | 10000000 | 10000000 | " |
| 01 00 01 01 | 10000000 | 10000000 | 10000000 | " |
| 01 00 01 10 | 10000000 | 10000000 | 10000000 | " |
| 01 00 01 11 | 10000000 | 10000000 | 10000000 | " |
| 01 00 10 00 | 10000000 | 10000000 | 10000000 | " |
| 01 00 10 01 | 10000000 | 10000000 | 10000000 | " |
| 01 00 10 10 | 10000000 | 10000000 | 10000000 | " |
| 01 00 10 11 | 10000000 | 10000000 | 10000000 | " |
| 01 00 11 00 | 10000000 | 10000000 | 10000000 | " |
| 01 00 11 01 | 10000000 | 10000000 | 10000000 | " |
| 01 00 11 10 | 10000000 | 10000000 | 10000000 | " |
| 01 00 11 11 | 10000000 | 10000000 | 10000000 | " |
| 01 01 00 00 | 10000000 | 10000000 | 10000000 | " |
| 01 01 00 01 | 10000000 | 10000000 | 10000000 | " |
| 01 01 00 10 | 10000000 | 10000000 | 10000000 | " |
| 01 01 00 11 | 10000000 | 10000000 | 10000000 | " |
| 01 01 01 00 | 10000000 | 10000000 | 10000000 | " |
| 01 01 01 01 | 10000000 | 10000000 | 10000000 | " |
| 01 01 01 10 | 10000000 | 10000000 | 10000000 | " |
| 01 01 01 11 | 10000000 | 10000000 | 10000000 | " |
| 01 01 10 00 | 10000000 | 10000000 | 10000000 | " |
| 01 01 10 01 | 10000000 | 10000000 | 10000000 | " |
| 01 01 10 10 | 10000000 | 10000000 | 10000000 | " |
| 01 01 10 11 | 10000000 | 10000000 | 10000000 | " |
| 01 01 11 00 | 10000000 | 10000000 | 10000000 | " |
| 01 01 11 01 | 10000000 | 10000000 | 10000000 | " |
| 01 01 11 10 | 10000000 | 10000000 | 10000000 | " |
| 01 01 11 11 | 10000000 | 10000000 | 10000000 | " |
| 01 10 00 00 | 10000000 | 10000000 | 10000000 | " |
| 01 10 00 01 | 10000000 | 10000000 | 10000000 | " |
| 01 10 00 10 | 10000000 | 10000000 | 10000000 | " |
| 01 10 00 11 | 10000000 | 10000000 | 10000000 | " |
| 01 10 01 00 | 10000000 | 10000000 | 10000000 | " |
| 01 10 01 01 | 10000000 | 10000000 | 10000000 | " |
| 01 10 01 10 | 10000000 | 10000000 | 10000000 | " |
| 01 10 01 11 | 10000000 | 10000000 | 10000000 | " |
| 01 10 10 00 | 10000000 | 10000000 | 10000000 | " |
| 01 10 10 01 | 10000000 | 10000000 | 10000000 | " |
| 01 10 10 10 | 10000000 | 10000000 | 10000000 | " |

| | | | | |
|---|---|---|---|---|
| 01 10 10 11 | 10000000 | 10000000 | 10000000 | " |
| 01 10 11 00 | 10000000 | 10000000 | 10000000 | " |
| 01 10 11 01 | 10000000 | 10000000 | 10000000 | " |
| 01 10 11 10 | 10000000 | 10000000 | 10000000 | " |
| 01 10 11 11 | 10000000 | 10000000 | 10000000 | " |
| 01 11 00 00 | 10000000 | 10000000 | 10000000 | " |
| 01 11 00 01 | 10000000 | 10000000 | 10000000 | " |
| 01 11 00 10 | 10000000 | 10000000 | 10000000 | " |
| 01 11 00 11 | 10000000 | 10000000 | 10000000 | " |
| 01 11 01 00 | 10000000 | 10000000 | 10000000 | " |
| 01 11 01 01 | 10000000 | 10000000 | 10000000 | " |
| 01 11 01 10 | 10000000 | 10000000 | 10000000 | " |
| 01 11 01 11 | 10000000 | 10000000 | 10000000 | " |
| 01 11 10 00 | 10000000 | 10000000 | 10000000 | " |
| 01 11 10 01 | 10000000 | 10000000 | 10000000 | " |
| 01 11 10 10 | 10000000 | 10000000 | 10000000 | " |
| 01 11 10 11 | 10000000 | 10000000 | 10000000 | " |
| 01 11 11 00 | 10000000 | 10000000 | 10000000 | " |
| 01 11 11 01 | 10000000 | 10000000 | 10000000 | " |
| 01 11 11 10 | 10000000 | 10000000 | 10000000 | " |
| 01 11 11 11 | 10000000 | 10000000 | 10000000 | " |
| 10 00 00 00 | 11111111 | 11111111 | 00000000 | " |
| 10 00 00 01 | 11111111 | 11111111 | 00000000 | " |
| 10 00 00 10 | 11111111 | 11111111 | 00000000 | " |
| 10 00 00 11 | 11111111 | 11111111 | 00000000 | " |
| 10 00 01 00 | 11111111 | 11111111 | 00000000 | " |
| 10 00 01 01 | 11111111 | 11111111 | 00000000 | " |
| 10 00 01 10 | 11111111 | 11111111 | 00000000 | " |
| 10 00 01 11 | 11111111 | 11111111 | 00000000 | " |
| 10 00 10 00 | 11111111 | 11111111 | 00000000 | " |
| 10 00 10 01 | 11111111 | 11111111 | 00000000 | " |
| 10 00 10 10 | 11111111 | 11111111 | 00000000 | " |
| 10 00 10 11 | 11111111 | 11111111 | 00000000 | " |
| 10 00 11 00 | 11111111 | 11111111 | 00000000 | " |
| 10 00 11 01 | 11111111 | 11111111 | 00000000 | " |
| 10 00 11 10 | 11111111 | 11111111 | 00000000 | " |
| 10 00 11 11 | 11111111 | 11111111 | 00000000 | " |
| 10 01 00 00 | 11111111 | 11111111 | 00000000 | " |
| 10 01 00 01 | 11111111 | 11111111 | 00000000 | " |
| 10 01 00 10 | 11111111 | 11111111 | 00000000 | " |
| 10 01 00 11 | 11111111 | 11111111 | 00000000 | " |
| 10 01 01 00 | 11111111 | 11111111 | 00000000 | " |
| 10 01 01 01 | 11111111 | 11111111 | 00000000 | " |
| 10 01 01 10 | 11111111 | 11111111 | 00000000 | " |
| 10 01 01 11 | 11111111 | 11111111 | 00000000 | " |
| 10 01 10 00 | 11111111 | 11111111 | 00000000 | " |
| 10 01 10 01 | 11111111 | 11111111 | 00000000 | " |
| 10 01 10 10 | 11111111 | 11111111 | 00000000 | " |
| 10 01 10 11 | 11111111 | 11111111 | 00000000 | " |
| 10 01 11 00 | 11111111 | 11111111 | 00000000 | " |
| 10 01 11 01 | 11111111 | 11111111 | 00000000 | " |
| 10 01 11 10 | 11111111 | 11111111 | 00000000 | " |
| 10 01 11 11 | 11111111 | 11111111 | 00000000 | " |
| 10 10 00 00 | 11111111 | 11111111 | 00000000 | " |
| 10 10 00 01 | 11111111 | 11111111 | 00000000 | " |
| 10 10 00 10 | 11111111 | 11111111 | 00000000 | " |
| 10 10 00 11 | 11111111 | 11111111 | 00000000 | " |
| 10 10 01 00 | 11111111 | 11111111 | 00000000 | " |
| 10 10 01 01 | 11111111 | 11111111 | 00000000 | " |
| 10 10 01 10 | 11111111 | 11111111 | 00000000 | " |
| 10 10 01 11 | 11111111 | 11111111 | 00000000 | " |
| 10 10 10 00 | 11111111 | 11111111 | 00000000 | " |
| 10 10 10 01 | 11111111 | 11111111 | 00000000 | " |
| 10 10 10 10 | 11111111 | 11111111 | 00000000 | " |
| 10 10 10 11 | 11111111 | 11111111 | 00000000 | " |
| 10 10 11 00 | 11111111 | 11111111 | 00000000 | " |
| 10 10 11 01 | 11111111 | 11111111 | 00000000 | " |
| 10 10 11 10 | 11111111 | 11111111 | 00000000 | " |
| 10 10 11 11 | 11111111 | 11111111 | 00000000 | " |
| 10 11 00 00 | 11111111 | 11111111 | 00000000 | " |

| | | | | |
|---|---|---|---|---|
| 10 11 00 01 | 11111111 | 11111111 | 00000000 | " |
| 10 11 00 10 | 11111111 | 11111111 | 00000000 | " |
| 10 11 00 11 | 11111111 | 11111111 | 00000000 | " |
| 10 11 01 00 | 11111111 | 11111111 | 00000000 | " |
| 10 11 01 01 | 11111111 | 11111111 | 00000000 | " |
| 10 11 01 10 | 11111111 | 11111111 | 00000000 | " |
| 10 11 01 11 | 11111111 | 11111111 | 00000000 | " |
| 10 11 10 00 | 11111111 | 11111111 | 00000000 | " |
| 10 11 10 01 | 11111111 | 11111111 | 00000000 | " |
| 10 11 10 10 | 11111111 | 11111111 | 00000000 | " |
| 10 11 10 11 | 11111111 | 11111111 | 00000000 | " |
| 10 11 11 00 | 11111111 | 11111111 | 00000000 | " |
| 10 11 11 01 | 11111111 | 11111111 | 00000000 | " |
| 10 11 11 10 | 11111111 | 11111111 | 00000000 | " |
| 10 11 11 11 | 11111111 | 11111111 | 00000000 | " |
| 11 00 00 00 | 00000000 | 10000000 | 11111111 | " |
| 11 00 00 01 | 00000000 | 10000000 | 11111111 | " |
| 11 00 00 10 | 00000000 | 10000000 | 11111111 | " |
| 11 00 00 11 | 00000000 | 10000000 | 11111111 | " |
| 11 00 01 00 | 00000000 | 10000000 | 11111111 | " |
| 11 00 01 01 | 00000000 | 10000000 | 11111111 | " |
| 11 00 01 10 | 00000000 | 10000000 | 11111111 | " |
| 11 00 01 11 | 00000000 | 10000000 | 11111111 | " |
| 11 00 10 00 | 00000000 | 10000000 | 11111111 | " |
| 11 00 10 01 | 00000000 | 10000000 | 11111111 | " |
| 11 00 10 10 | 00000000 | 10000000 | 11111111 | " |
| 11 00 10 11 | 00000000 | 10000000 | 11111111 | " |
| 11 00 11 00 | 00000000 | 10000000 | 11111111 | " |
| 11 00 11 01 | 00000000 | 10000000 | 11111111 | " |
| 11 00 11 10 | 00000000 | 10000000 | 11111111 | " |
| 11 00 11 11 | 00000000 | 10000000 | 11111111 | " |
| 11 01 00 00 | 00000000 | 10000000 | 11111111 | " |
| 11 01 00 01 | 00000000 | 10000000 | 11111111 | " |
| 11 01 00 10 | 00000000 | 10000000 | 11111111 | " |
| 11 01 00 11 | 00000000 | 10000000 | 11111111 | " |
| 11 01 01 00 | 00000000 | 10000000 | 11111111 | " |
| 11 01 01 01 | 00000000 | 10000000 | 11111111 | " |
| 11 01 01 10 | 00000000 | 10000000 | 11111111 | " |
| 11 01 01 11 | 00000000 | 10000000 | 11111111 | " |
| 11 01 10 00 | 00000000 | 10000000 | 11111111 | " |
| 11 01 10 01 | 00000000 | 10000000 | 11111111 | " |
| 11 01 10 10 | 00000000 | 10000000 | 11111111 | " |
| 11 01 10 11 | 00000000 | 10000000 | 11111111 | " |
| 11 01 11 00 | 00000000 | 10000000 | 11111111 | " |
| 11 01 11 01 | 00000000 | 10000000 | 11111111 | " |
| 11 01 11 10 | 00000000 | 10000000 | 11111111 | " |
| 11 01 11 11 | 00000000 | 10000000 | 11111111 | " |
| 11 10 00 00 | 00000000 | 10000000 | 11111111 | " |
| 11 10 00 01 | 00000000 | 10000000 | 11111111 | " |
| 11 10 00 10 | 00000000 | 10000000 | 11111111 | " |
| 11 10 00 11 | 00000000 | 10000000 | 11111111 | " |
| 11 10 01 00 | 00000000 | 10000000 | 11111111 | " |
| 11 10 01 01 | 00000000 | 10000000 | 11111111 | " |
| 11 10 01 10 | 00000000 | 10000000 | 11111111 | " |
| 11 10 01 11 | 00000000 | 10000000 | 11111111 | " |
| 11 10 10 00 | 00000000 | 10000000 | 11111111 | " |
| 11 10 10 01 | 00000000 | 10000000 | 11111111 | " |
| 11 10 10 10 | 00000000 | 10000000 | 11111111 | " |
| 11 10 10 11 | 00000000 | 10000000 | 11111111 | " |
| 11 10 11 00 | 00000000 | 10000000 | 11111111 | " |
| 11 10 11 01 | 00000000 | 10000000 | 11111111 | " |
| 11 10 11 10 | 00000000 | 10000000 | 11111111 | " |
| 11 10 11 11 | 00000000 | 10000000 | 11111111 | " |
| 11 11 00 00 | 00000000 | 10000000 | 11111111 | " |
| 11 11 00 01 | 00000000 | 10000000 | 11111111 | " |
| 11 11 00 10 | 00000000 | 10000000 | 11111111 | " |
| 11 11 00 11 | 00000000 | 10000000 | 11111111 | " |
| 11 11 01 00 | 00000000 | 10000000 | 11111111 | " |
| 11 11 01 01 | 00000000 | 10000000 | 11111111 | " |

| | | | | |
|---|---|---|---|---|
| 11 11 01 10 | 00000000 | 10000000 | 11111111 | " |
| 11 11 01 11 | 00000000 | 10000000 | 11111111 | " |
| 11 11 10 00 | 00000000 | 10000000 | 11111111 | " |
| 11 11 10 01 | 00000000 | 10000000 | 11111111 | " |
| 11 11 10 10 | 00000000 | 10000000 | 11111111 | " |
| 11 11 10 11 | 00000000 | 10000000 | 11111111 | " |
| 11 11 11 00 | 00000000 | 10000000 | 11111111 | " |
| 11 11 11 01 | 00000000 | 10000000 | 11111111 | " |
| 11 11 11 10 | 00000000 | 10000000 | 11111111 | " |
| 11 11 11 11 | 00000000 | 10000000 | 11111111 | " |

---

Case 2. Assume that we want the true-color surface to take priority over the indexed color surface. Then the hardware color map would be populated as:

bit numbers
76 54 32 10

| color map address | color map data R | G | B | (remarks) |
|---|---|---|---|---|
| 00 00 00 00 | 00000000 | 00000000 | 00000000 | (background color) |
| 00 00 00 01 | 00000000 | 00000000 | 01010101 | (from true color sur |
| 00 00 00 10 | 00000000 | 00000000 | 10101010 | " |
| 00 00 00 11 | 00000000 | 00000000 | 11111111 | " |
| 00 00 01 00 | 00000000 | 01010101 | 11111111 | " |
| 00 00 01 01 | 00000000 | 01010101 | 11111111 | " |
| 00 00 01 10 | 00000000 | 01010101 | 11111111 | " |
| 00 00 01 11 | 00000000 | 01010101 | 11111111 | " |
| 00 00 10 00 | 00000000 | 10101010 | 00000000 | " |
| 00 00 10 01 | 00000000 | 10101010 | 01010101 | " |
| 00 00 10 10 | 00000000 | 10101010 | 10101010 | " |
| 00 00 10 11 | 00000000 | 10101010 | 11111111 | " |
| 00 00 11 00 | 00000000 | 11111111 | 00000000 | " |
| 00 00 11 01 | 00000000 | 11111111 | 01010101 | " |
| 00 00 11 10 | 00000000 | 11111111 | 10101010 | " |
| 00 00 11 11 | 00000000 | 11111111 | 11111111 | " |
| 00 01 00 00 | 01010101 | 00000000 | 00000000 | " |
| 00 01 00 01 | 01010101 | 00000000 | 01010101 | " |
| 00 01 00 10 | 01010101 | 00000000 | 10101010 | " |
| 00 01 00 11 | 01010101 | 00000000 | 11111111 | " |
| 00 01 01 00 | 01010101 | 01010101 | 00000000 | " |
| 00 01 01 01 | 01010101 | 01010101 | 01010101 | " |
| 00 01 01 10 | 01010101 | 01010101 | 10101010 | " |
| 00 01 01 11 | 01010101 | 01010101 | 11111111 | " |
| 00 01 10 00 | 01010101 | 10101010 | 00000000 | " |
| 00 01 10 01 | 01010101 | 10101010 | 01010101 | " |
| 00 01 10 10 | 01010101 | 10101010 | 10101010 | " |
| 00 01 10 11 | 01010101 | 10101010 | 11111111 | " |
| 00 01 11 00 | 01010101 | 11111111 | 00000000 | " |
| 00 01 11 01 | 01010101 | 11111111 | 01010101 | " |
| 00 01 11 10 | 01010101 | 11111111 | 10101010 | " |
| 00 01 11 11 | 01010101 | 11111111 | 11111111 | " |
| 00 10 00 00 | 10101010 | 00000000 | 00000000 | " |
| 00 10 00 01 | 10101010 | 00000000 | 01010101 | " |
| 00 10 00 10 | 10101010 | 00000000 | 10101010 | " |
| 00 10 00 11 | 10101010 | 00000000 | 11111111 | " |
| 00 10 01 00 | 10101010 | 01010101 | 00000000 | " |
| 00 10 01 01 | 10101010 | 01010101 | 01010101 | " |
| 00 10 01 10 | 10101010 | 01010101 | 10101010 | " |
| 00 10 01 11 | 10101010 | 01010101 | 11111111 | " |
| 00 10 10 00 | 10101010 | 10101010 | 00000000 | " |
| 00 10 10 01 | 10101010 | 10101010 | 01010101 | " |
| 00 10 10 10 | 10101010 | 10101010 | 10101010 | " |
| 00 10 10 11 | 10101010 | 10101010 | 11111111 | " |
| 00 10 11 00 | 10101010 | 11111111 | 00000000 | " |

| | | | | |
|---|---|---|---|---|
| 00 10 11 01 | 10101010 | 11111111 | 01010101 | " |
| 00 10 11 10 | 10101010 | 11111111 | 10101010 | " |
| 00 10 11 11 | 10101010 | 11111111 | 11111111 | " |
| 00 11 00 00 | 11111111 | 00000000 | 00000000 | " |
| 00 11 00 01 | 11111111 | 00000000 | 01010101 | " |
| 00 11 00 10 | 11111111 | 00000000 | 10101010 | " |
| 00 11 00 11 | 11111111 | 00000000 | 11111111 | " |
| 00 11 01 00 | 11111111 | 01010101 | 00000000 | " |
| 00 11 01 01 | 11111111 | 01010101 | 01010101 | " |
| 00 11 01 10 | 11111111 | 01010101 | 10101010 | " |
| 00 11 01 11 | 11111111 | 01010101 | 11111111 | " |
| 00 11 10 00 | 11111111 | 10101010 | 00000000 | " |
| 00 11 10 01 | 11111111 | 10101010 | 01010101 | " |
| 00 11 10 10 | 11111111 | 10101010 | 10101010 | " |
| 00 11 10 11 | 11111111 | 10101010 | 11111111 | " |
| 00 11 11 00 | 11111111 | 11111111 | 00000000 | " |
| 00 11 11 01 | 11111111 | 11111111 | 01010101 | " |
| 00 11 11 10 | 11111111 | 11111111 | 10101010 | " |
| 00 11 11 11 | 11111111 | 11111111 | 11111111 | " |
| 01 00 00 00 | 10000000 | 10000000 | 10000000 | (from indexed surface |
| 01 00 00 01 | 00000000 | 00000000 | 01010101 | (from true color surf |
| 01 00 00 10 | 00000000 | 00000000 | 10101010 | " |
| 01 00 00 11 | 00000000 | 00000000 | 11111111 | " |
| 01 00 01 00 | 00000000 | 01010101 | 11111111 | " |
| 01 00 01 01 | 00000000 | 01010101 | 11111111 | " |
| 01 00 01 10 | 00000000 | 01010101 | 11111111 | " |
| 01 00 01 11 | 00000000 | 01010101 | 11111111 | " |
| 01 00 10 00 | 00000000 | 10101010 | 00000000 | " |
| 01 00 10 01 | 00000000 | 10101010 | 01010101 | " |
| 01 00 10 10 | 00000000 | 10101010 | 10101010 | " |
| 01 00 10 11 | 00000000 | 10101010 | 11111111 | " |
| 01 00 11 00 | 00000000 | 11111111 | 00000000 | " |
| 01 00 11 01 | 00000000 | 11111111 | 01010101 | " |
| 01 00 11 10 | 00000000 | 11111111 | 10101010 | " |
| 01 00 11 11 | 00000000 | 11111111 | 11111111 | " |
| 01 01 00 00 | 01010101 | 00000000 | 00000000 | " |
| 01 01 00 01 | 01010101 | 00000000 | 01010101 | " |
| 01 01 00 10 | 01010101 | 00000000 | 10101010 | " |
| 01 01 00 11 | 01010101 | 00000000 | 11111111 | " |
| 01 01 01 00 | 01010101 | 01010101 | 00000000 | " |
| 01 01 01 01 | 01010101 | 01010101 | 01010101 | " |
| 01 01 01 10 | 01010101 | 01010101 | 10101010 | " |
| 01 01 01 11 | 01010101 | 01010101 | 11111111 | " |
| 01 01 10 00 | 01010101 | 10101010 | 00000000 | " |
| 01 01 10 01 | 01010101 | 10101010 | 01010101 | " |
| 01 01 10 10 | 01010101 | 10101010 | 10101010 | " |
| 01 01 10 11 | 01010101 | 10101010 | 11111111 | " |
| 01 01 11 00 | 01010101 | 11111111 | 00000000 | " |
| 01 01 11 01 | 01010101 | 11111111 | 01010101 | " |
| 01 01 11 10 | 01010101 | 11111111 | 10101010 | " |
| 01 01 11 11 | 01010101 | 11111111 | 11111111 | " |
| 01 10 00 00 | 10101010 | 00000000 | 00000000 | " |
| 01 10 00 01 | 10101010 | 00000000 | 01010101 | " |
| 01 10 00 10 | 10101010 | 00000000 | 10101010 | " |
| 01 10 00 11 | 10101010 | 00000000 | 11111111 | " |
| 01 10 01 00 | 10101010 | 01010101 | 00000000 | " |
| 01 10 01 01 | 10101010 | 01010101 | 01010101 | " |
| 01 10 01 10 | 10101010 | 01010101 | 10101010 | " |
| 01 10 01 11 | 10101010 | 01010101 | 11111111 | " |
| 01 10 10 00 | 10101010 | 10101010 | 00000000 | " |
| 01 10 10 01 | 10101010 | 10101010 | 01010101 | " |
| 01 10 10 10 | 10101010 | 10101010 | 10101010 | " |
| 01 10 10 11 | 10101010 | 10101010 | 11111111 | " |
| 01 10 11 00 | 10101010 | 11111111 | 00000000 | " |
| 01 10 11 01 | 10101010 | 11111111 | 01010101 | " |
| 01 10 11 10 | 10101010 | 11111111 | 10101010 | " |
| 01 10 11 11 | 10101010 | 11111111 | 11111111 | " |
| 01 11 00 00 | 11111111 | 00000000 | 00000000 | " |
| 01 11 00 01 | 11111111 | 00000000 | 01010101 | " |
| 01 11 00 10 | 11111111 | 00000000 | 10101010 | " |

| | | | | |
|---|---|---|---|---|
| 01 11 00 11 | 11111111 | 00000000 | 11111111 | " |
| 01 11 01 00 | 11111111 | 01010101 | 00000000 | " |
| 01 11 01 01 | 11111111 | 01010101 | 01010101 | " |
| 01 11 01 10 | 11111111 | 01010101 | 10101010 | " |
| 01 11 01 11 | 11111111 | 01010101 | 11111111 | " |
| 01 11 10 00 | 11111111 | 10101010 | 00000000 | " |
| 01 11 10 01 | 11111111 | 10101010 | 01010101 | " |
| 01 11 10 10 | 11111111 | 10101010 | 10101010 | " |
| 01 11 10 11 | 11111111 | 10101010 | 11111111 | " |
| 01 11 11 00 | 11111111 | 11111111 | 00000000 | " |
| 01 11 11 01 | 11111111 | 11111111 | 01010101 | " |
| 01 11 11 10 | 11111111 | 11111111 | 10101010 | " |
| 01 11 11 11 | 11111111 | 11111111 | 11111111 | " |
| 10 00 00 00 | 11111111 | 11111111 | 00000000 | (from indexed surfac |
| 10 00 00 01 | 00000000 | 00000000 | 01010101 | (from true color sur |
| 10 00 00 10 | 00000000 | 00000000 | 10101010 | " |
| 10 00 00 11 | 00000000 | 00000000 | 11111111 | " |
| 10 00 01 00 | 00000000 | 01010101 | 11111111 | " |
| 10 00 01 01 | 00000000 | 01010101 | 11111111 | " |
| 10 00 01 10 | 00000000 | 01010101 | 11111111 | " |
| 10 00 01 11 | 00000000 | 01010101 | 11111111 | " |
| 10 00 10 00 | 00000000 | 10101010 | 00000000 | " |
| 10 00 10 01 | 00000000 | 10101010 | 01010101 | " |
| 10 00 10 10 | 00000000 | 10101010 | 10101010 | " |
| 10 00 10 11 | 00000000 | 10101010 | 11111111 | " |
| 10 00 11 00 | 00000000 | 11111111 | 00000000 | " |
| 10 00 11 01 | 00000000 | 11111111 | 01010101 | " |
| 10 00 11 10 | 00000000 | 11111111 | 10101010 | " |
| 10 00 11 11 | 00000000 | 11111111 | 11111111 | " |
| 10 01 00 00 | 01010101 | 00000000 | 00000000 | " |
| 10 01 00 01 | 01010101 | 00000000 | 01010101 | " |
| 10 01 00 10 | 01010101 | 00000000 | 10101010 | " |
| 10 01 00 11 | 01010101 | 00000000 | 11111111 | " |
| 10 01 01 00 | 01010101 | 01010101 | 00000000 | " |
| 10 01 01 01 | 01010101 | 01010101 | 01010101 | " |
| 10 01 01 10 | 01010101 | 01010101 | 10101010 | " |
| 10 01 01 11 | 01010101 | 01010101 | 11111111 | " |
| 10 01 10 00 | 01010101 | 10101010 | 00000000 | " |
| 10 01 10 01 | 01010101 | 10101010 | 01010101 | " |
| 10 01 10 10 | 01010101 | 10101010 | 10101010 | " |
| 10 01 10 11 | 01010101 | 10101010 | 11111111 | " |
| 10 01 11 00 | 01010101 | 11111111 | 00000000 | " |
| 10 01 11 01 | 01010101 | 11111111 | 01010101 | " |
| 10 01 11 10 | 01010101 | 11111111 | 10101010 | " |
| 10 01 11 11 | 01010101 | 11111111 | 11111111 | " |
| 10 10 00 00 | 10101010 | 00000000 | 00000000 | " |
| 10 10 00 01 | 10101010 | 00000000 | 01010101 | " |
| 10 10 00 10 | 10101010 | 00000000 | 10101010 | " |
| 10 10 00 11 | 10101010 | 00000000 | 11111111 | " |
| 10 10 01 00 | 10101010 | 01010101 | 00000000 | " |
| 10 10 01 01 | 10101010 | 01010101 | 01010101 | " |
| 10 10 01 10 | 10101010 | 01010101 | 10101010 | " |
| 10 10 01 11 | 10101010 | 01010101 | 11111111 | " |
| 10 10 10 00 | 10101010 | 10101010 | 00000000 | " |
| 10 10 10 01 | 10101010 | 10101010 | 01010101 | " |
| 10 10 10 10 | 10101010 | 10101010 | 10101010 | " |
| 10 10 10 11 | 10101010 | 10101010 | 11111111 | " |
| 10 10 11 00 | 10101010 | 11111111 | 00000000 | " |
| 10 10 11 01 | 10101010 | 11111111 | 01010101 | " |
| 10 10 11 10 | 10101010 | 11111111 | 10101010 | " |
| 10 10 11 11 | 10101010 | 11111111 | 11111111 | " |
| 10 11 00 00 | 11111111 | 00000000 | 00000000 | " |
| 10 11 00 01 | 11111111 | 00000000 | 01010101 | " |
| 10 11 00 10 | 11111111 | 00000000 | 10101010 | " |
| 10 11 00 11 | 11111111 | 00000000 | 11111111 | " |
| 10 11 01 00 | 11111111 | 01010101 | 00000000 | " |
| 10 11 01 01 | 11111111 | 01010101 | 01010101 | " |
| 10 11 01 10 | 11111111 | 01010101 | 10101010 | " |
| 10 11 01 11 | 11111111 | 01010101 | 11111111 | " |
| 10 11 10 00 | 11111111 | 10101010 | 00000000 | " |

| | | | | |
|---|---|---|---|---|
| 10 11 10 01 | 11111111 | 10101010 | 01010101 | " |
| 10 11 10 10 | 11111111 | 10101010 | 10101010 | " |
| 10 11 10 11 | 11111111 | 10101010 | 11111111 | " |
| 10 11 11 00 | 11111111 | 11111111 | 00000000 | " |
| 10 11 11 01 | 11111111 | 11111111 | 01010101 | " |
| 10 11 11 10 | 11111111 | 11111111 | 10101010 | " |
| 10 11 11 11 | 11111111 | 11111111 | 11111111 | " |
| 11 00 00 00 | 00000000 | 00000000 | 11111111 | (from indexed surface |
| 11 00 00 01 | 00000000 | 00000000 | 01010101 | (from true color surf |
| 11 00 00 10 | 00000000 | 00000000 | 10101010 | " |
| 11 00 00 11 | 00000000 | 00000000 | 11111111 | " |
| 11 00 01 00 | 00000000 | 01010101 | 11111111 | " |
| 11 00 01 01 | 00000000 | 01010101 | 11111111 | " |
| 11 00 01 10 | 00000000 | 01010101 | 11111111 | " |
| 11 00 01 11 | 00000000 | 01010101 | 11111111 | " |
| 11 00 10 00 | 00000000 | 10101010 | 00000000 | " |
| 11 00 10 01 | 00000000 | 10101010 | 01010101 | " |
| 11 00 10 10 | 00000000 | 10101010 | 10101010 | " |
| 11 00 10 11 | 00000000 | 10101010 | 11111111 | " |
| 11 00 11 00 | 00000000 | 11111111 | 00000000 | " |
| 11 00 11 01 | 00000000 | 11111111 | 01010101 | " |
| 11 00 11 10 | 00000000 | 11111111 | 10101010 | " |
| 11 00 11 11 | 00000000 | 11111111 | 11111111 | " |
| 11 01 00 00 | 01010101 | 00000000 | 00000000 | " |
| 11 01 00 01 | 01010101 | 00000000 | 01010101 | " |
| 11 01 00 10 | 01010101 | 00000000 | 10101010 | " |
| 11 01 00 11 | 01010101 | 00000000 | 11111111 | " |
| 11 01 01 00 | 01010101 | 01010101 | 00000000 | " |
| 11 01 01 01 | 01010101 | 01010101 | 01010101 | " |
| 11 01 01 10 | 01010101 | 01010101 | 10101010 | " |
| 11 01 01 11 | 01010101 | 01010101 | 11111111 | " |
| 11 01 10 00 | 01010101 | 10101010 | 00000000 | " |
| 11 01 10 01 | 01010101 | 10101010 | 01010101 | " |
| 11 01 10 10 | 01010101 | 10101010 | 10101010 | " |
| 11 01 10 11 | 01010101 | 10101010 | 11111111 | " |
| 11 01 11 00 | 01010101 | 11111111 | 00000000 | " |
| 11 01 11 01 | 01010101 | 11111111 | 01010101 | " |
| 11 01 11 10 | 01010101 | 11111111 | 10101010 | " |
| 11 01 11 11 | 01010101 | 11111111 | 11111111 | " |
| 11 10 00 00 | 10101010 | 00000000 | 00000000 | " |
| 11 10 00 01 | 10101010 | 00000000 | 01010101 | " |
| 11 10 00 10 | 10101010 | 00000000 | 10101010 | " |
| 11 10 00 11 | 10101010 | 00000000 | 11111111 | " |
| 11 10 01 00 | 10101010 | 01010101 | 00000000 | " |
| 11 10 01 01 | 10101010 | 01010101 | 01010101 | " |
| 11 10 01 10 | 10101010 | 01010101 | 10101010 | " |
| 11 10 01 11 | 10101010 | 01010101 | 11111111 | " |
| 11 10 10 00 | 10101010 | 10101010 | 00000000 | " |
| 11 10 10 01 | 10101010 | 10101010 | 01010101 | " |
| 11 10 10 10 | 10101010 | 10101010 | 10101010 | " |
| 11 10 10 11 | 10101010 | 10101010 | 11111111 | " |
| 11 10 11 00 | 10101010 | 11111111 | 00000000 | " |
| 11 10 11 01 | 10101010 | 11111111 | 01010101 | " |
| 11 10 11 10 | 10101010 | 11111111 | 10101010 | " |
| 11 10 11 11 | 10101010 | 11111111 | 11111111 | " |
| 11 11 00 00 | 11111111 | 00000000 | 00000000 | " |
| 11 11 00 01 | 11111111 | 00000000 | 01010101 | " |
| 11 11 00 10 | 11111111 | 00000000 | 10101010 | " |
| 11 11 00 11 | 11111111 | 00000000 | 11111111 | " |
| 11 11 01 00 | 11111111 | 01010101 | 00000000 | " |
| 11 11 01 01 | 11111111 | 01010101 | 01010101 | " |
| 11 11 01 10 | 11111111 | 01010101 | 10101010 | " |
| 11 11 01 11 | 11111111 | 01010101 | 11111111 | " |
| 11 11 10 00 | 11111111 | 10101010 | 00000000 | " |
| 11 11 10 01 | 11111111 | 10101010 | 01010101 | " |
| 11 11 10 10 | 11111111 | 10101010 | 10101010 | " |
| 11 11 10 11 | 11111111 | 10101010 | 11111111 | " |
| 11 11 11 00 | 11111111 | 11111111 | 00000000 | " |
| 11 11 11 01 | 11111111 | 11111111 | 01010101 | " |
| 11 11 11 10 | 11111111 | 11111111 | 10101010 | " |
| 11 11 11 11 | 11111111 | 11111111 | 11111111 | " |

We claim:

1. A method of representing multi-dimensional data values in a one-dimensional memory addressing system, the method comprising the steps of:

producing multi-dimensional data values calculated from user-specified numbers of data levels, each user-specified number representing a quantity of data values in a dimension;

storing the multi-dimensional data values in a memory in a predetermined sequence suitable for referencing by a one-dimensional address; and producing the one-dimensional address calculated from a user-specified multi-dimensional data value, the one-dimensional address being effective for referencing multi-dimensional data values stored in the memory corresponding to the user-specified multi-dimensional data value.

* * * * *